US011566795B2

(12) United States Patent
Peng et al.

(10) Patent No.: US 11,566,795 B2
(45) Date of Patent: Jan. 31, 2023

(54) AIR CONDITIONER INDOOR UNIT

(71) Applicants: GD MIDEA AIR-CONDITIONING EQUIPMENT CO., LTD., Foshan (CN); MIDEA GROUP CO., LTD., Foshan (CN)

(72) Inventors: Daijie Peng, Foshan (CN); Zhihang Chen, Foshan (CN); Tao Zhang, Foshan (CN); Peng Xie, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 566 days.

(21) Appl. No.: 16/499,627

(22) PCT Filed: Mar. 28, 2019

(86) PCT No.: PCT/CN2019/080065
§ 371 (c)(1),
(2) Date: Sep. 30, 2019

(87) PCT Pub. No.: WO2020/172938
PCT Pub. Date: Sep. 3, 2020

(65) Prior Publication Data

US 2021/0332985 A1 Oct. 28, 2021

(30) Foreign Application Priority Data

Feb. 25, 2019 (CN) ..... 201910143726.3
Feb. 25, 2019 (CN) ..... 201920239558.3

(51) Int. Cl.
*F24F 1/0014* (2019.01)
*F24F 13/14* (2006.01)
*F24F 13/20* (2006.01)

(52) U.S. Cl.
CPC ..... *F24F 1/0014* (2013.01); *F24F 13/1426* (2013.01); *F24F 13/1486* (2013.01); *F24F 13/20* (2013.01); *F24F 2013/1446* (2013.01)

(58) Field of Classification Search
CPC .. F24F 1/0014; F24F 13/1426; F24F 13/1486; F24F 13/20; F24F 2013/1446
(Continued)

(56) References Cited

U.S. PATENT DOCUMENTS

2017/0115027 A1* 4/2017 Lee ..... F24F 13/22
2018/0209668 A1 7/2018 Ha et al.
(Continued)

FOREIGN PATENT DOCUMENTS

CN 205351517 U 6/2016
CN 106287969 A 1/2017
(Continued)

OTHER PUBLICATIONS

Choi, Sung Gyu, KR101633782 Translation.pdf, "Airconditioner", Jun. 2016, pp. 1-26.*
(Continued)

*Primary Examiner* — Avinash A Savani
*Assistant Examiner* — Ryan L Faulkner
(74) *Attorney, Agent, or Firm* — Anova Law Group PLLC

(57) ABSTRACT

An air conditioner indoor unit includes a back plate assembly, a top cover assembly having a part connected to a top wall of the back plate assembly, and a panel assembly. The panel assembly includes a first panel connected to the back plate assembly and including a first air outlet and a second air outlet arranged below the first air outlet, a second panel disposed below the first panel, a door mounting plate disposed at rear of the first panel and including a guiding groove, a door coupled to the door mounting plate and
(Continued)

movable relative to the door mounting plate to open or close the first air outlet, and a guiding post arranged at the door and configured to extend into and slide relative to the guiding groove. The back plate assembly, the top cover assembly, the first panel, and the second panel are connected one to another.

14 Claims, 23 Drawing Sheets

(58) Field of Classification Search
USPC ..... 454/361
See application file for complete search history.

(56) References Cited

U.S. PATENT DOCUMENTS

| | | | | |
|---|---|---|---|---|
| 2018/0216835 | A1* | 8/2018 | Yun | F24F 1/005 |
| 2018/0274795 | A1* | 9/2018 | Lee | F24F 1/0043 |

FOREIGN PATENT DOCUMENTS

| | | | | |
|---|---|---|---|---|
| CN | 106958866 | A | 7/2017 | |
| CN | 206669886 | U | 11/2017 | |
| CN | 207113012 | U | 3/2018 | |
| CN | 107965844 | A | 4/2018 | |
| CN | 108895543 | A | 11/2018 | |
| JP | 2003035437 | A | 2/2003 | |
| JP | 2016195888 | * | 10/2016 | F24F 13/12 |
| KR | 20100012306 | A | 2/2010 | |
| KR | 101633782 | B1 | 6/2016 | |
| KR | 20180056613 | A | 5/2018 | |
| WO | 2019001184 | A1 | 1/2019 | |

OTHER PUBLICATIONS

Intellectual Property Office of Korea (IPKR) The Office Action For KR Application No. 10-2019-7030462 dated Nov. 19, 2020 12 Pages (Translation Included ).

Intellectual Property Office of Korea (IPKR) Notification of Reason for Refusal for KR Application No. 10-2019-7030462 dated Jul. 14, 2021 11 Pages (including translation).

Japan Patent Office (JPO) Notice of Reasons for Refusal for JP Application No. 2019-556246 dated Jul. 20, 2021 8 Pages (including translation).

The European Patent Office (EPO) Extended Search Report for EP Application No. 19778419.2 dated Jul. 28, 2020 9 Pages.

World Intellectual Property Organization (WIPO) International Search Report and Written Opinion for PCT/CN2019/080065 dated Nov. 28, 2019 20 Pages.

Japan Patent Office (JPO) The Notice of Reasons for Refusal For JP Application No. 2019-556246 dated Dec. 21, 2021 6 Pages (Translation Included).

* cited by examiner

AIR CONDITIONER INDOOR UNIT

CROSS-REFERENCE TO RELATED APPLICATIONS

The present application is a National Stage Entry under 35 U.S.C. § 371 of International Application No. PCT/CN2019/080065, filed Mar. 28, 2019, which claims priority to and benefit of Chinese Patent Application Nos. 201920239558.3 and 201910143726.3 filed on Feb. 25, 2019, the entire contents of which are incorporated herein by reference.

FIELD

The present disclosure relates to the field of air handling equipment, and in particular to an air conditioner indoor unit.

BACKGROUND

In the air conditioner indoor units based on relative technologies, the front panel of the panel assembly is mostly an integrally formed part which requires a large injection mold and a resulting high cost in the production process. Also, the front panel requires a long time for injection molding, which affects the production efficiency of the panel assembly. Moreover, the front panel is subject to a large amount of deformation and a high scrap rate. On the other hand, the door used for opening and closing the air outlet on the panel assembly in the air conditioner indoor unit is not stable enough, so the reliability of the air conditioner indoor unit is affected to some extent. At the same time, the single ventilation type of air conditioner indoor unit cannot meet the user's demands.

SUMMARY

The purpose of the present disclosure is to address at least one of the technical problems in the related art. Therefore, an objective of the present disclosure is to provide an air conditioner indoor unit, which has a low manufacturing cost of the panel assembly, a high production efficiency, a high yield, and a stable operation of the door, thus improving the reliability of the air conditioner indoor unit and realizing different ventilation effects, so as to satisfy the user's demands to a certain extent.

An air conditioner indoor unit according to an embodiment of the present disclosure includes: a back plate assembly; a top cover assembly, a part of the top cover assembly being connected to a top wall of the back plate assembly; a panel assembly. The panel assembly includes: a first panel, a top end of the first panel is connected to another part of the top cover assembly, the first panel being arranged in front of the back plate assembly and connected to the back plate assembly, the first panel being provided with a first air outlet and a second air outlet arranged in sequence in an up and down direction; a second panel disposed below the first panel, and connected to a lower end of the first panel and the back plate assembly, respectively, and the second panel and the first panel being independently processed and molded; a door mounting plate disposed at the rear of the first panel, and provided with a guiding groove; a door arranged between the first panel and the door mounting plate, the door being movable relative to the door mounting plate so as to open or close the first air outlet, a guiding post being arranged at the door and configured to extend into the guiding groove, and the guiding post being slidable relative to the guiding groove.

In the air conditioner indoor unit according to the embodiment of the present disclosure, by making the panel assembly include the independently processed first panel and second panel, the size and cost of the required mold for manufacturing the panel assembly can be reduced to some extent, and thereby reduce the cooling and solidification time required for injection molding of panel assembly, improving the production efficiency of the panel assembly. At the same time, the problem of large deformation due to the large size of the first panel and the second panel can be avoided to some extent, thus improving the yield of the first panel and the second panel. The first air outlet and the second air outlet are arranged in the first panel in the up and down direction, which is favorable to achieve different ventilation effect, and can meet the user's demands to a certain extent. It can improve the ventilation efficiency of the air conditioner indoor unit, and can also expand the ventilation range of the air conditioner indoor unit. By making the panel assembly include a door mounting plate and a door, the door is movable relative to the door mounting plate so as to open or close the first air outlet, and at the same time, a guiding groove is arranged at the door mounting plate, and a guiding post is arranged at the door. And the guiding post is adapted to extend into the guiding groove and is slidable relative to the guiding groove. Thereby, the air conditioner indoor unit can be sealed to prevent particles such as dust in the room from entering the interior of the air conditioner indoor unit through the first air outlet. At the same time, the engaging structure between the door and the door mounting plate can be made stronger, the operation of the door can be more stable, the reliability of the panel assembly can be improved, and the reliability of the air conditioner indoor unit can be improved.

According to some embodiments of the present disclosure, at least a portion of the guiding groove extends obliquely downwards in a direction approaching the first panel, and the door closes the first air outlet when the guiding post slides to an inclined portion of the guiding groove.

In some embodiments of the present disclosure, the air conditioner indoor unit further includes a limiting connector, wherein one end of the limiting connector is slidably disposed at the door mounting plate, and the other end of the limiting connector is rotatably disposed at the door so that the limiting connector is configured to drive the door to move.

Further, the air conditioner indoor unit further includes a drive mechanism, wherein the drive mechanism is connected to the limiting connector to drive the limiting connector to slide, so as to drive the door to move.

Specifically, the drive mechanism includes: an actuator disposed at the door mounting plate; a drive gear connected to the actuator and driven to rotate by the actuator; a rack connected to the limiting connector, and engaged with the driving gear to drive the limiting connector to slide.

According to some embodiments of the present disclosure, a side of the first panel facing the back plate assembly is provided with an engaging hook, the back plate assembly is provided with an engaging buckle, and the engaging hook is configured to extend into the engaging buckle.

In some embodiments of the present disclosure, the engaging hook comprises a horizontal extension section and a vertical extension section, one end of the horizontal extension section is disposed at the first panel, the other end of the horizontal extension section is connected to an upper end of the vertical extension section, and a lower end of the vertical extension section is configured to extend into the engaging buckle.

In some embodiments of the present disclosure, the engaging buckle is configured as a hollow structure.

According to some embodiments of the present disclosure, a top of a side of the first panel facing the back plate assembly is provided with an extension extending towards the back plate assembly, a lower end of the extension is provided with a positioning post, a top of the back plate assembly is provided with a positioning hole, and the positioning post is configured to extend into the positioning hole.

In some embodiments of the present disclosure, the extension is provided with a first engaging hole, the back plate assembly is provided with a second engaging hole, and the second engaging hole is disposed opposite to the first engaging hole. The air conditioner indoor unit further comprises a first connector, and the first connector passes through the first engaging hole and the second engaging hole to connect the first panel with the back plate assembly.

According to some embodiments of the present disclosure, a bottom of a side of the first panel facing the back plate assembly is provided with a positioning pin extending towards the back plate assembly, the back plate assembly is provided with a positioning receptacle, and the positioning pin is configured to be inserted into the positioning receptacle.

In some embodiments of the present disclosure, the first panel is provided with a third engaging hole, the third engaging hole is disposed adjacent to the positioning pin, the back plate assembly is provided with a fourth engaging hole, and the fourth engaging hole is disposed opposite to the third engaging hole. The air conditioner indoor unit further comprises a second connector, and the second connector passes through the third engaging hole and the fourth engaging hole so as to connect the first panel with the back plate assembly.

According to some embodiments of the present disclosure, the panel assembly further comprises an opening and closing member, and the opening and closing member is configured to move back and forth to open or close the second air outlet, and when the opening and closing member moves forwards to be in the front of the second air outlet, the opening and closing member opens the second air outlet.

According to some embodiments of the present disclosure, a top of the first panel is provided with a plurality of first reinforce ribs spaced apart from one another.

According to some embodiments of the present disclosure, an outer surface of the first panel is configured as a curved surface.

Additional aspects and benefits of the present disclosure will be presented in the following sections, which will become apparent from the following descriptions or through the practice of the present disclosure.

BRIEF DESCRIPTION OF THE DRAWINGS

The above and/or additional aspects and advantages of the present disclosure will become apparent and easy to understand from the description of embodiments in combination with the attached drawings below, in which.

REFERENCE NUMERALS

Figure 1:
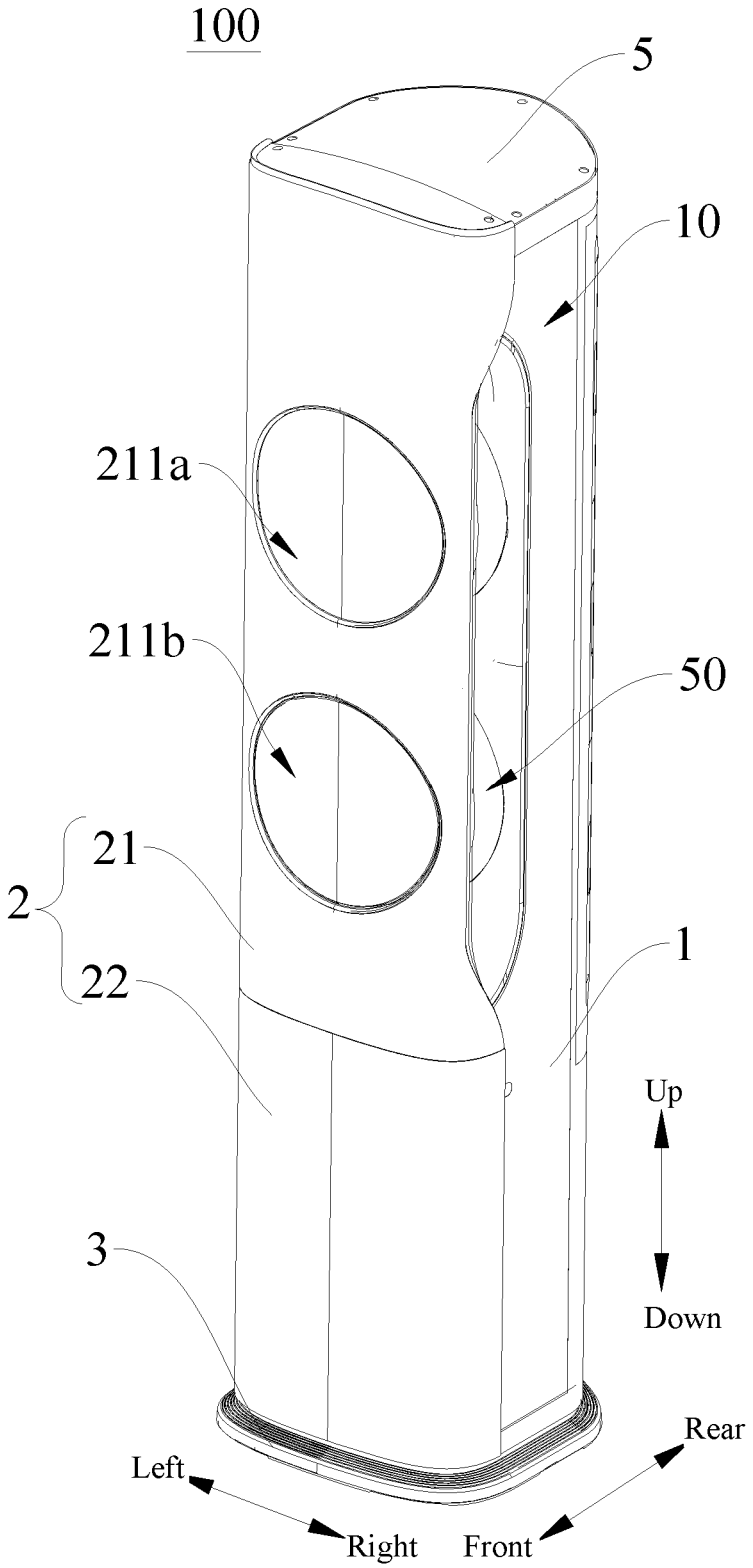
FIG. 1 is a schematic view of an air conditioner indoor unit based on some embodiments of the present disclosure.

Air conditioner indoor unit 100;

Housing 10;

Back plate assembly 1;

Positioning hole 11; second engaging hole 12; positioning receptacle; fourth engaging hole 14; engaging buckle 15; engaging groove 16; sixth engaging hole 16*a*; operation groove 17; connection jack 18;

Panel assembly 2;

First panel 21; first air outlet 211*a*; second air outlet 211*b*; connection plate 212; guiding jack 212*a*; engaging groove 212*b*; second support plate 213; first reinforce rib 214; second thickness reducing zone b; extension 215; positioning post 215*a*; first engaging hole 215*b*; positioning pin 216; third engaging hole 217; engaging hook 218; horizontal extension section 218*a*; vertical extension section 218*b;*

Second panel 22; fixing plate 221; guiding pin 221*a*; engaging clip bulge 221*b*; third reinforce rib 222; third thickness reducing zone c; first support plate 223; engaging pin 223*a*; second reinforce rib 224; first thickness reducing zone a; engaging post 225; fifth engaging hole 225*a*; connection pin 226; fourth reinforce rib 227;

Door mounting plate 23; guiding groove 231; first guide section 231*a*; second guide section 231*b;*

Door 24; guiding post 241;

Opening and closing member 25;

Chassis 3; engaging jack 31; protection cover 4; notch 41; top cover assembly 5; limiting connector 6;

Fan 20; first fan 201; second 202;
Electrical controller 30;
Drive mechanism 40; drive gear 401; driving gear 401*a*; driven gear 401*b*; rack 402;
Air outlet frame assembly 50.

DETAILED DESCRIPTIONS

The embodiments of the present disclosure are described in detail below, and examples of the embodiments are shown in the attached drawings, where throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

An air conditioner indoor unit 100 according to embodiments of the present disclosure is described below with reference to the drawings, and the air conditioner indoor unit can be wall-mounted unit or cabinet.

Figure 2:
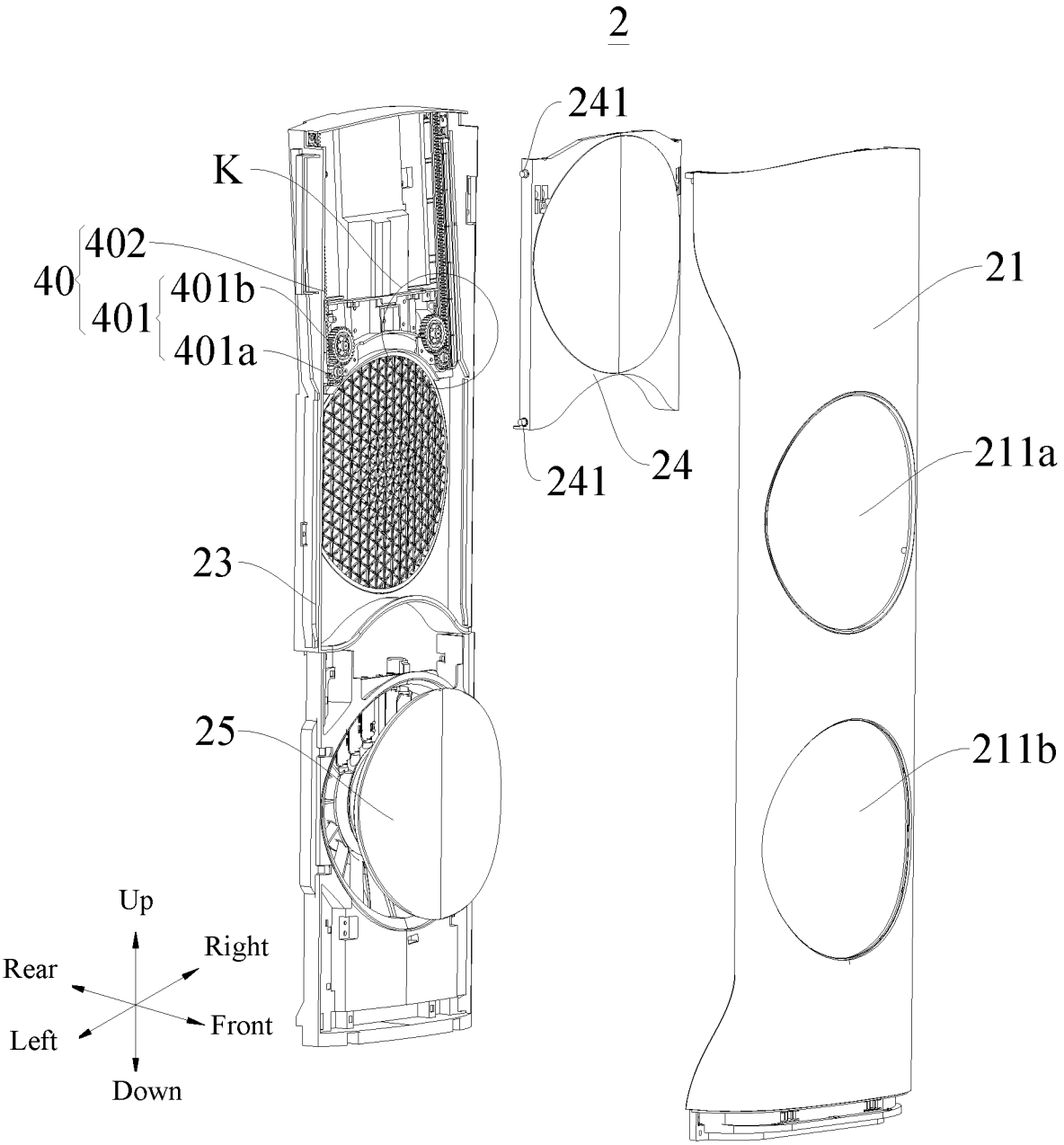
FIG. 2 is a partial structural explosion view of panel assembly based on some embodiments of the present disclosure.

As shown in FIGS. 1 and 2, an air conditioner indoor unit 100 based on an embodiment of the present disclosure includes a back plate assembly 1, a top cover assembly 5, and a panel assembly 2.

Specifically, a part of the top cover assembly 5 is attached to the top wall of the back plate assembly 1. The panel assembly 2 includes a first panel 21, a second panel 22, a door mounting plate 23, and a door 24.

The top end of the first panel 21 is connected to another part of the top cover assembly 5. It can be seen that the top cover assembly 5 is connected to the back plate assembly 1 and the first panel 21, respectively.

The first panel 21 is in front of the back plate assembly 1 and connected to it. The first air outlet 211*a* and the second air outlet 211*b* are arranged in the first panel 21 in the up and down direction. The second panel 22 is disposed below the first panel 21, and the second panel 22 is connected to the lower end of the first panel 21 and the back plate assembly 1, respectively, and the second panel 22 and the first panel 21 are independently processed and molded. It can be seen that the first panel 21 is connected to the top cover assembly 5, the back plate assembly 1, and the second panel 22, respectively. Thereby, the reliability of the position of the first panel 21 can be ensured. The first panel 21 is above the second panel 22, and the first air outlet 211*a* and the second air outlet 211*b* are provided on the first panel 21, so that the air conditioner indoor unit 100 can send air above the panel member 2. That is, the air conditioner indoor unit 100 based on the embodiment of the present disclosure can simultaneously supply air to the indoor space through the first air outlet 211*a* and the second air outlet 211*b*, or supply air only through the first air outlet 211*a* or supply air only through the second air outlet 211*b*, which helps to achieve different air supply effects and improve the comfort of the indoor environment, and thereby meet the user's demands to a certain extent. Further, it can improve the ventilation efficiency of the air conditioner indoor unit 100, and can also expand the ventilation range of the air conditioner indoor unit.

It is also known that the first panel 21 and the second panel 22 together constitute the front panel of the panel assembly 2. Compared with the integrated front panel based on the prior technology, in the air conditioner indoor unit 100 based on the embodiment of the present disclosure, the size and cost of the required mold for manufacturing the panel assembly 2 can be reduced to some extent, it takes relatively short time for injection molding of the first panel 21 and the second panel 22, and thereby reduce the cooling and solidification time required for injection molding of panel assembly, improving the production efficiency of panel assembly 2. At the same time, since the first panel 21 and the second panel 22 are separately processed and molded, the problem of large deformation due to the large size of the first panel 21 and the second panel 22 can be avoided to some extent, thus improving the yield of the first panel 21 and the second panel 22.

The door mounting plate 23 is disposed at the rear of the first panel 21, and the door mounting plate 23 is provided with a guiding groove 231. The door 24 is set between the first panel 21 and the door mounting plate 23, and the door 24 is movable relative to the door mounting plate 23 so as to open or close the first air outlet 211*a*. The door 24 is provided with a guiding post 241 which is adapted to extend into the guiding groove 231 and slidable relative to the guiding groove 231. Therefore, when the air conditioner indoor unit 100 starts to work, the door 24 can be moved forward (for example, upward) the door mounting plate 23 so as to open the first air outlet 211*a*, and the heat exchange flow can pass through the first air outlet 211*a* and flow into indoor space. When the air conditioner indoor unit 100 stops working, the door 24 can move opposite to (for example, downward) the door mounting plate 23 so as to close the first air outlet 211*a*, thus providing a certain sealing effect on the first air outlet 211*a* and preventing particles such as dust in the room from entering the inside of the air conditioner indoor unit 100 through the first air outlet 211*a*.

At the same time, the guiding post 241 and the guiding groove 231 are disposed in such a way that the guiding post 241 can extend into the guiding groove 231. When the door 24 moves relative to the door mounting plate 23, the guiding post 241 can be engaged by sliding with the guiding groove 231. Therefore, the engaging structure between the door 24 and the door mounting plate 23 can be made stronger, and the operation of the door 24 can be more stable. The reliability of the panel assembly 2 can be improved, and the reliability of the air conditioner indoor unit 100 can be improved.

An air conditioner indoor unit 100 based on the embodiment of the present disclosure, by making the panel assembly 2 include the independently processed first panel 21 and second panel 22, the size and cost of the required mold for manufacturing the panel assembly 2 can be reduced to some extent, and thereby reduce the cooling and solidification time required for injection molding of panel assembly, improving the production efficiency of panel assembly 2. At the same time, the problem of large deformation due to the large size of the first panel 21 and the second panel 22 can be avoided to some extent, thus improving the yield of the first panel 21 and the second panel 22. The first air outlet 211*a* and the second air outlet 211*b* are arranged in the first panel 21 in the up and down direction. Further, it can realize different ventilation effects and improve the ventilation efficiency of the air conditioner indoor unit 100, and can also expand the ventilation range of the air conditioner indoor unit 100. By making the panel assembly 2 includes a door mounting plate 23 and a door 24, the door 24 is movable relative to the door mounting plate 23 so as to open or close the first air outlet 211*a*, and at the same time, a guiding groove 231 is arranged at the door mounting plate 23, and a guiding post 241 is arranged at the door 24. And the guiding post 241 is adapted to extend into the guiding groove 231 and is slidable relative to the guiding groove 231. Thereby, the air conditioner indoor unit 100 can be sealed to some extent, so as to prevent particles such as dust in the room from entering the interior of the air conditioner indoor unit 100 through the first air outlet 211*a*. At the same time, the engaging structure between the door 24 and the door mounting plate 23 can be made stronger, the operation of the door 24 can be more stable, the reliability of the panel assembly 2 can be improved, and the reliability of the air conditioner indoor unit 100 can be improved.

Figure 3:
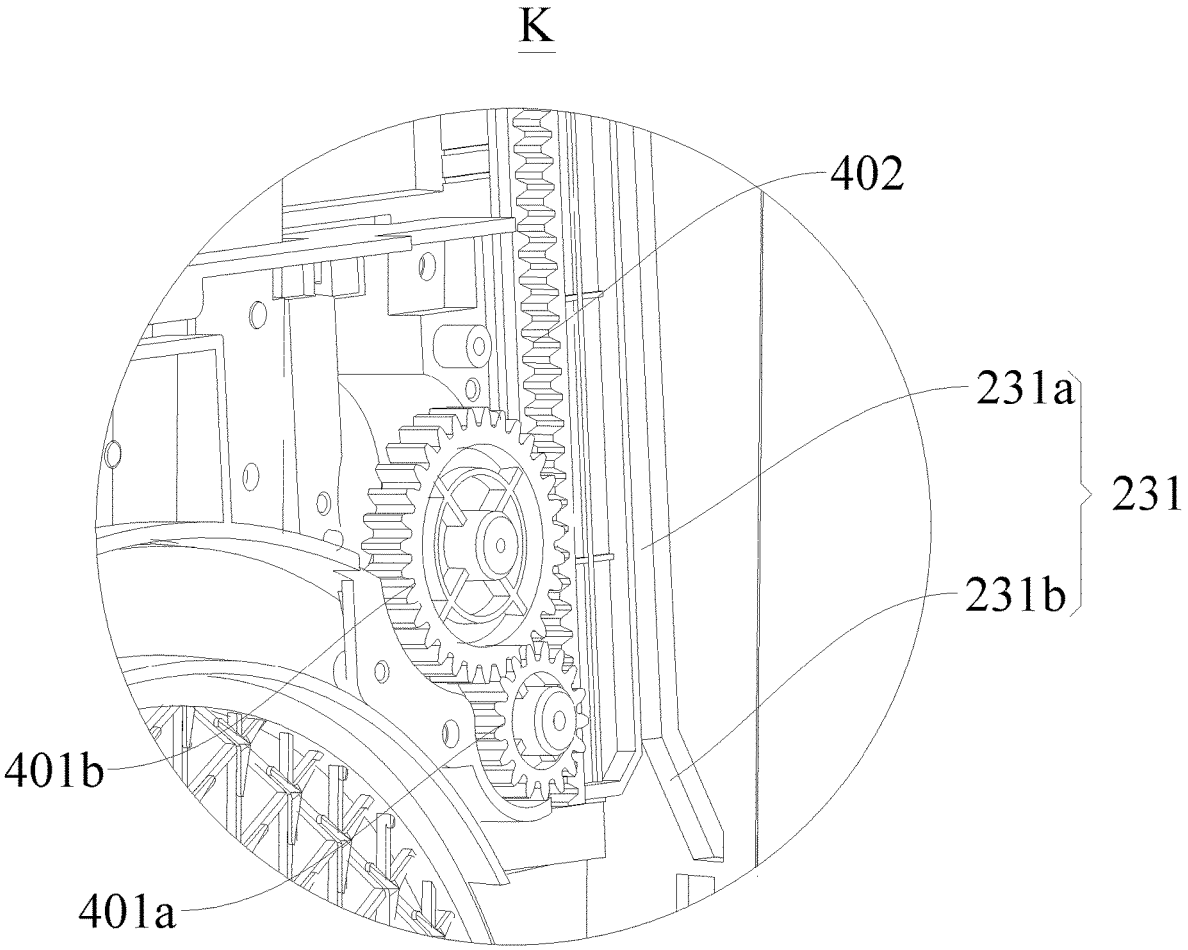
FIG. 3 is an enlarged view of Area K in FIG. 2.

As shown in FIG. 3, according to some embodiments of the present disclosure, at least a portion of the guiding groove 231 extends obliquely downward in a direction approaching the first panel 21, and the door 24 closes the first air outlet 211*a* when the guiding post 241 slides to an inclined portion of the guiding groove 231. This shows that the door 24 moves upward relative to the door mounting plate 23 so as to open the first air outlet 211*a*, and the door 24 moves upward relative to the door mounting plate 23 so as to close the first air outlet 211*a*. When the door 24 closes the first air outlet 211*a*, the door 24 moves downward and forward relative to the door mounting plate 23.

For example, as shown in FIG. 3, the guiding groove 231 can include a first guide section 231*a* and a second guide section 231*b*. The first guide section 231*a* may extend vertically up and down, and the second guide section 231*b* may be disposed under the first guide section 231*a*. In the direction from up to down, the second guide section 231*b* may extend obliquely downward toward the first air outlet 211*a*. When the door 24 closes the first air outlet 211*a*, the door 24 can first slide from up to down along the first guide section 231*a*. When the door 24 slides to the second guide section 231*b*, the second guide section 231*b* can guide the door 24 to slide toward the first air outlet 211*a*, thereby shortening the distance between the door 24 and the first air outlet 211*a*. Thus, by the above arrangement, not only the sealing effect between the door 24 and the first air outlet 211*a* can be improved, but also the running resistance of the door 24 can be reduced, and the operation of the door 24 can be made smoother.

Optionally, as shown in FIG. 2, there can be two guiding grooves 231, and the two guiding grooves 231 may be spaced apart from each other along the width direction of the door mounting plate 23, and the guiding post 241 may be disposed at the left and right side walls of the door 24. For example, set two on each side. When the door 24 is assembled with the door mounting plate 23, the guiding posts 241 on the left and right side walls of the door 24 can respectively extend into the corresponding guide slots 231, thereby realize the multi-point connection between door 24 and the door mounting plate 23, thus making the operation of the door 24 more stable.

Figure 21:
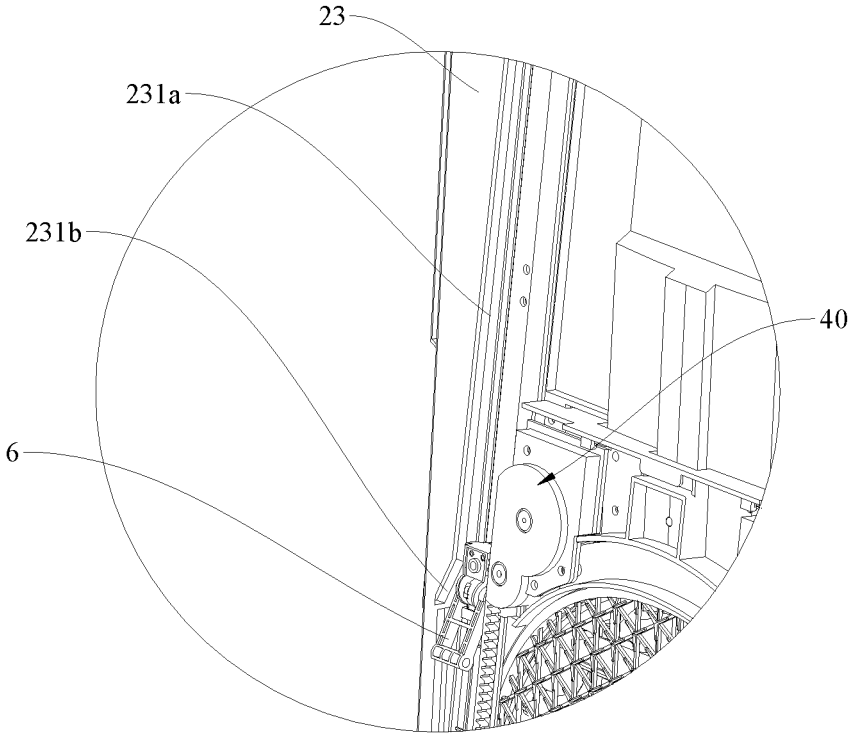
FIG. 21 is a partial structure enlarged view of an air conditioner indoor unit based on some embodiments of the present disclosure.

In some embodiments of the present disclosure, as shown in FIG. 21, the air conditioner indoor unit 100 further includes a limiting connector 6, one end of the limiting connector 6 is slidably disposed at the door mounting plate 23, and the other end of the limiting connector 6 is rotatably disposed at the door 24 so that the limiting connector 6 can drive the door 24 to move. It can be seen that the door 24 is movable relative to the door mounting plate 23 so as to open or close the first air outlet 211*a*, and the door can be driven by the limiting connector 6 to move.

Further, as shown in FIG. 2, the air conditioner indoor unit 100 further includes a drive mechanism 40, and the drive mechanism 40 is connected to the limiting connector 6 so as to drive the limiting connector 6 to slide and thereby drive the door 24 to move. Therefore, the reason why the door 24 is able to open and close the first air outlet 211*a* is that the drive mechanism 40 drives the limiting connector 6 to slide and then the limiting connector 6 drives the door 24 to move. Thereby, the automatic control of the door 24 can be realized, and the operation of the air conditioner indoor unit 100 can be made more convenient. For example, the drive mechanism 40 can form a communication link with the air conditioner remote controller, and thereby can operate the air conditioner remote controller to control the working state of the drive mechanism 40, thus achieving the purpose of automatically opening or closing the first air outlet 211*a*.

Specifically, as shown in FIG. 2, the drive mechanism 40 includes an actuator (not shown in the drawing), a drive gear 401, and a rack 402. The actuator is disposed at the door mounting plate 23. The drive gear 401 is coupled to the actuator and driven to rotate by the actuator. The rack 402 is coupled to the limiting connector 6, and the rack 402 is in engagement with the drive gear 401 to drive the limiting connector 6 to slide. Thus, with the above arrangement, the structural design of the drive mechanism 40 can be made simpler. Moreover, the operation of the rack 402 is more stable, and the smoothness of running of the door 24 is improved.

Optionally, the actuator can be a stepping motor, and the stepping motor has the characteristics of stable operation, precise control of the rotation angle thereof and the number of rotation revolutions, so as to accurately control the movement of the door 24 by controlling the number of rotations of the actuator, the door 24 can fully open or close the first air outlet 211*a*.

In the specific example shown in FIG. 2, the drive gear 401 may further include a driving gear 401*a* and a driven gear 401*b*, wherein the driving gear 401*a* may be coupled to the actuator to be driven to rotate by the actuator, and the driven gear 401*b* is simultaneously engaged with both driving gear 401*a* and the rack 402 so as to transmit power. Thereby, the driving gear 401*a* and the driven gear 401*b* can cooperate to adjust the running speed of the rack 402, and can also improve the smoothness of running of the rack 402.

Figure 8:
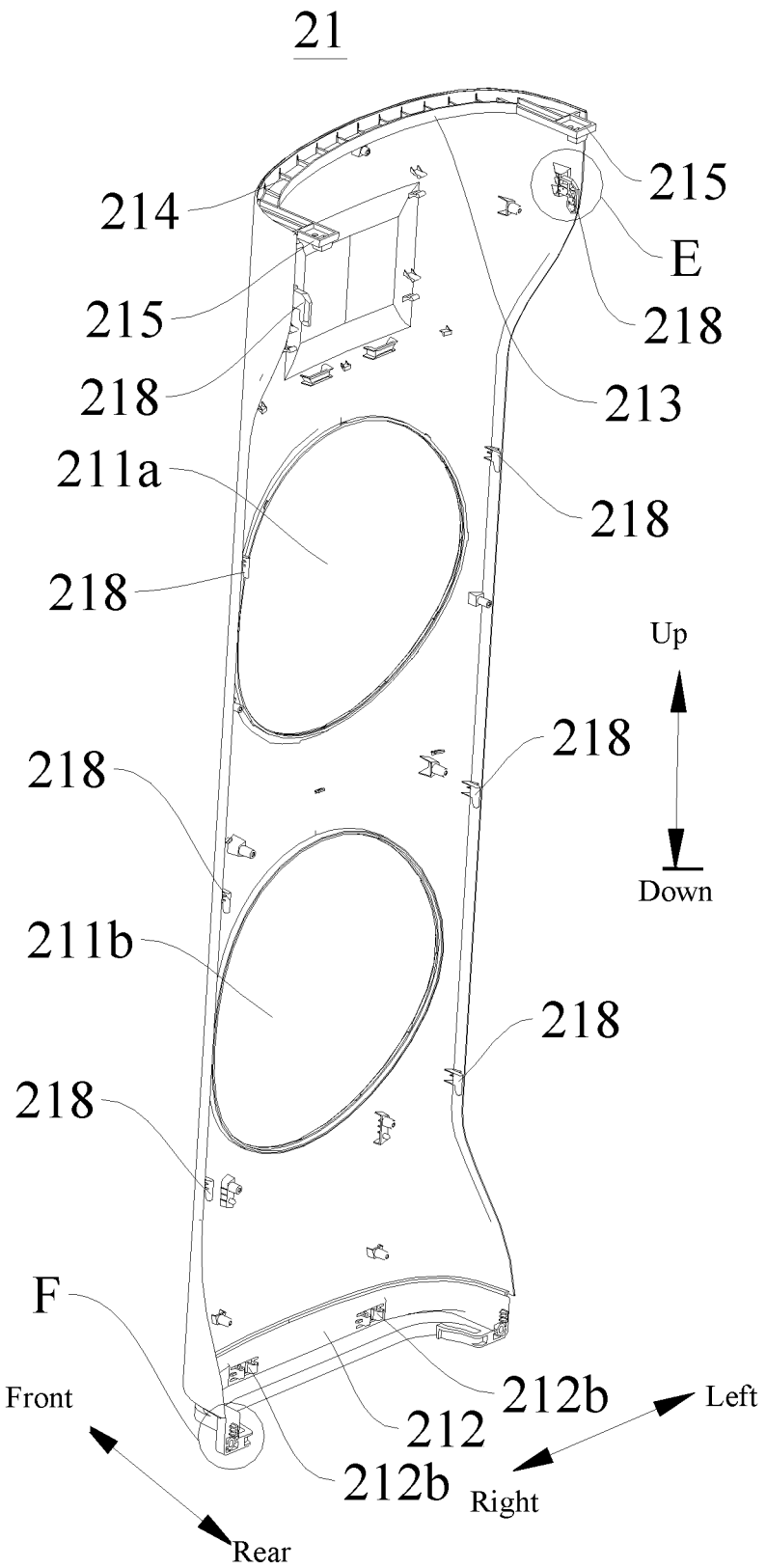
FIG. 8 is a schematic view of the first panel based on some embodiments of the present disclosure.
Figure 11:
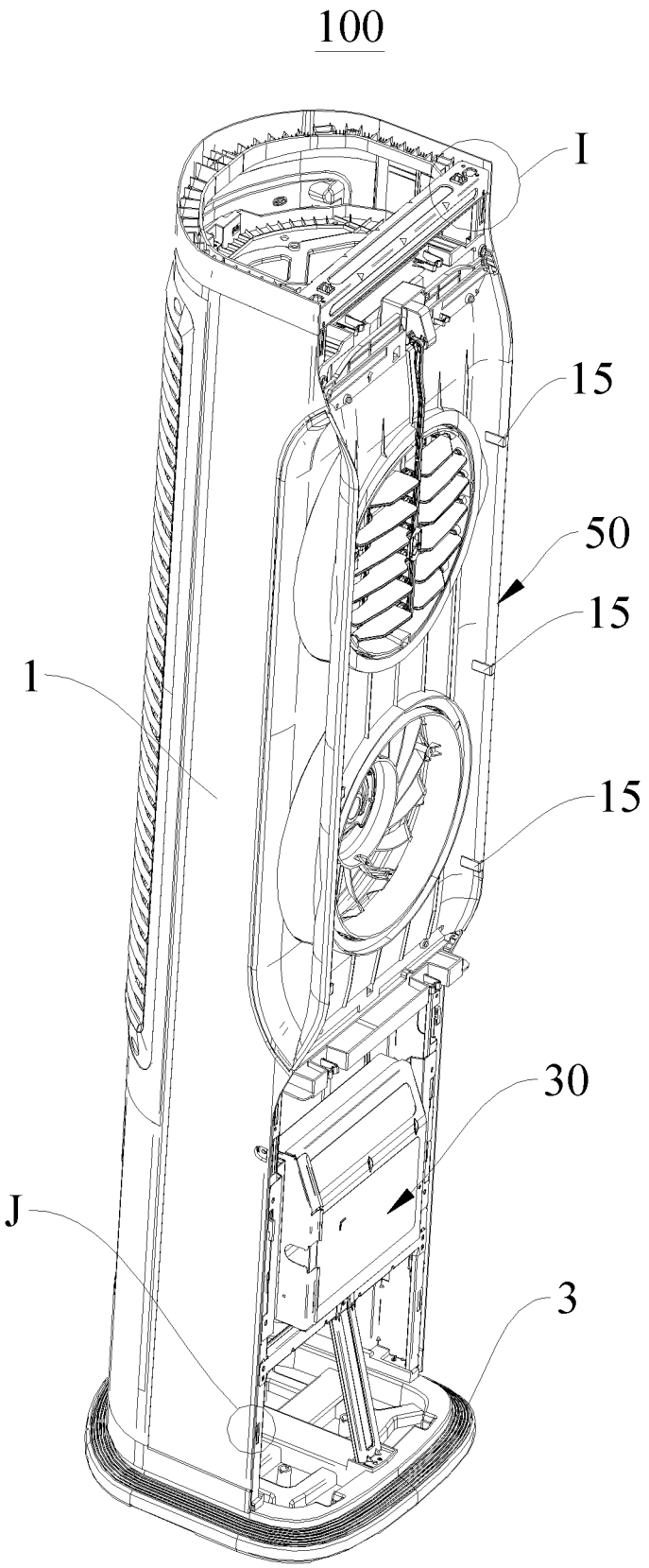
FIG. 11 is a partial schematic view of an air conditioner indoor unit based on some embodiments of the present disclosure.
Figure 12:
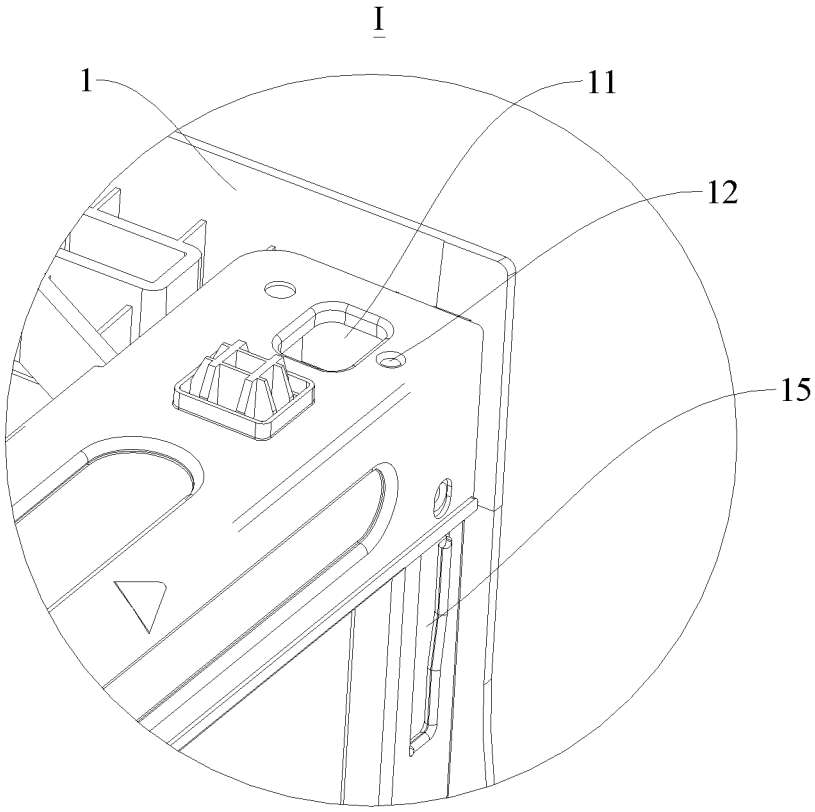
FIG. 12 is an enlarged view of Area I in FIG. 11.

According to some embodiments of the present disclosure, as shown in FIG. 8, one side of the first panel 21 facing the back plate assembly 1 is provided with an engaging hook 218; and as shown in FIGS. 11 and 12, the back plate assembly 1 is provided with an engaging buckle 15 where the engaging hook 218 extends. It can be seen that the first panel 21 can be connected to the back plate assembly 1 by the engagement between the engaging hook 218 and the engaging buckle 15. Thereby, the manner in which the first panel 21 and the back plate assembly 1 are connected is simple and reliable.

Figure 15:
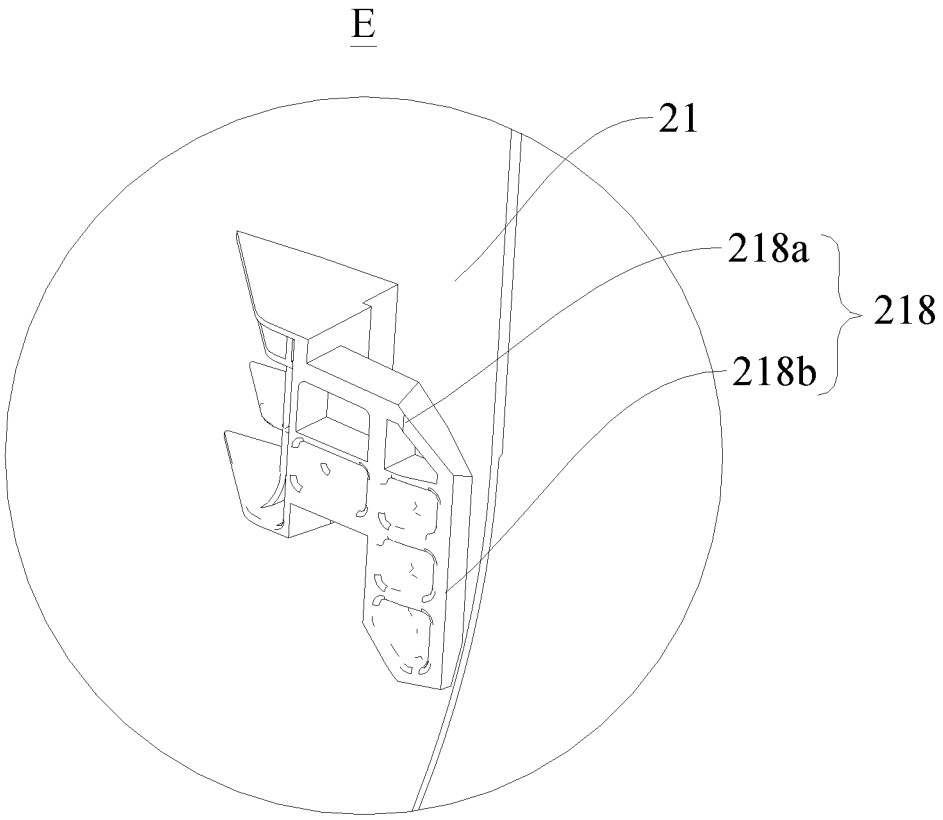
FIG. 15 is an enlarged view of Area E in FIG. 8.

As shown in FIG. 15, in some embodiments of the present disclosure, the engaging hook 218 includes a horizontal extension section 218*a* and a vertical extension section 218*b*, one end of the horizontal extension section 218*a* is disposed at the first panel 21, and the other end of the horizontal extension section 218*a* is connected to the upper end of the vertical extension section 218*b*, and the lower end of the vertical extension section 218*b* is adapted to extend into the engaging buckle 15. Therefore, it can be seen that the engaging hook 218 is formed substantially in a "7" shape, making the structure of the engaging hook 218 simpler and convenient to manufacture. When the first panel 21 is engaged with the back plate assembly 1, the lower end of the vertical extension section 218*b* needs to be engaged with the engaging buckle 15, and then the first panel 21 is pushed downward so that the vertical extension section 218*b* can fully extend into the engaging buckle 15 and securely engage with the engaging buckle 15, playing a prepositioning role through engagement between the engaging hook 218 and the engaging buckle 15, making the connection between the first panel 21 and the back plate assembly 1 more reliably, thereby improving the reliability of the air conditioner indoor unit 100.

In some embodiments of the present disclosure, as shown in FIG. 15, the engaging buckle 15 is formed as a hollow structure. Consequently, the strength of the engaging hook 218 is improved, the strength of the joint between the first panel 21 and the back plate assembly 1 is improved, and the material consumption of the first panel 21 is reduced, and the cost is reduced.

Figure 4:
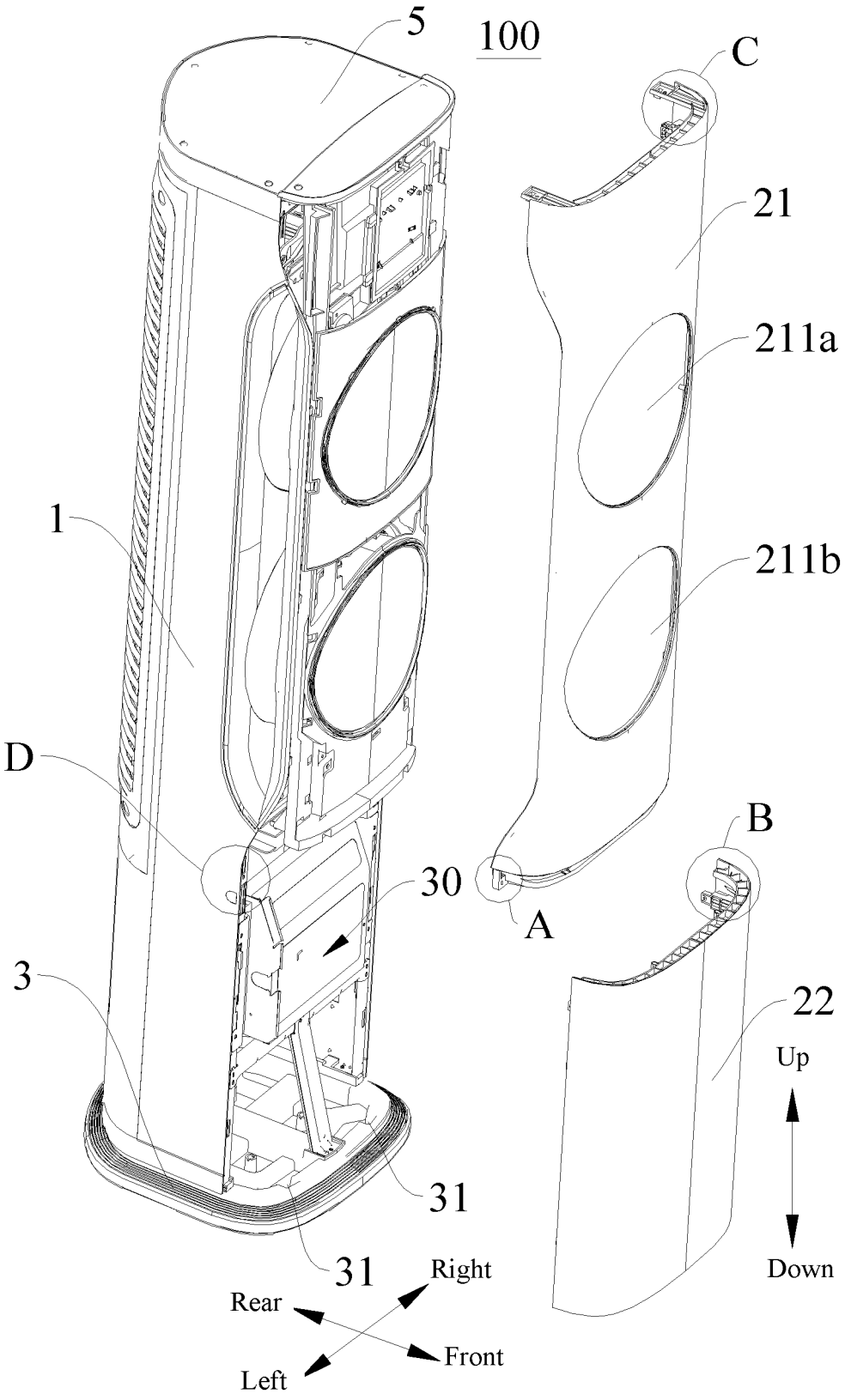
FIG. 4 is a partial structural explosion view of an air conditioner indoor unit based on some embodiments of the present disclosure.
Figure 10:
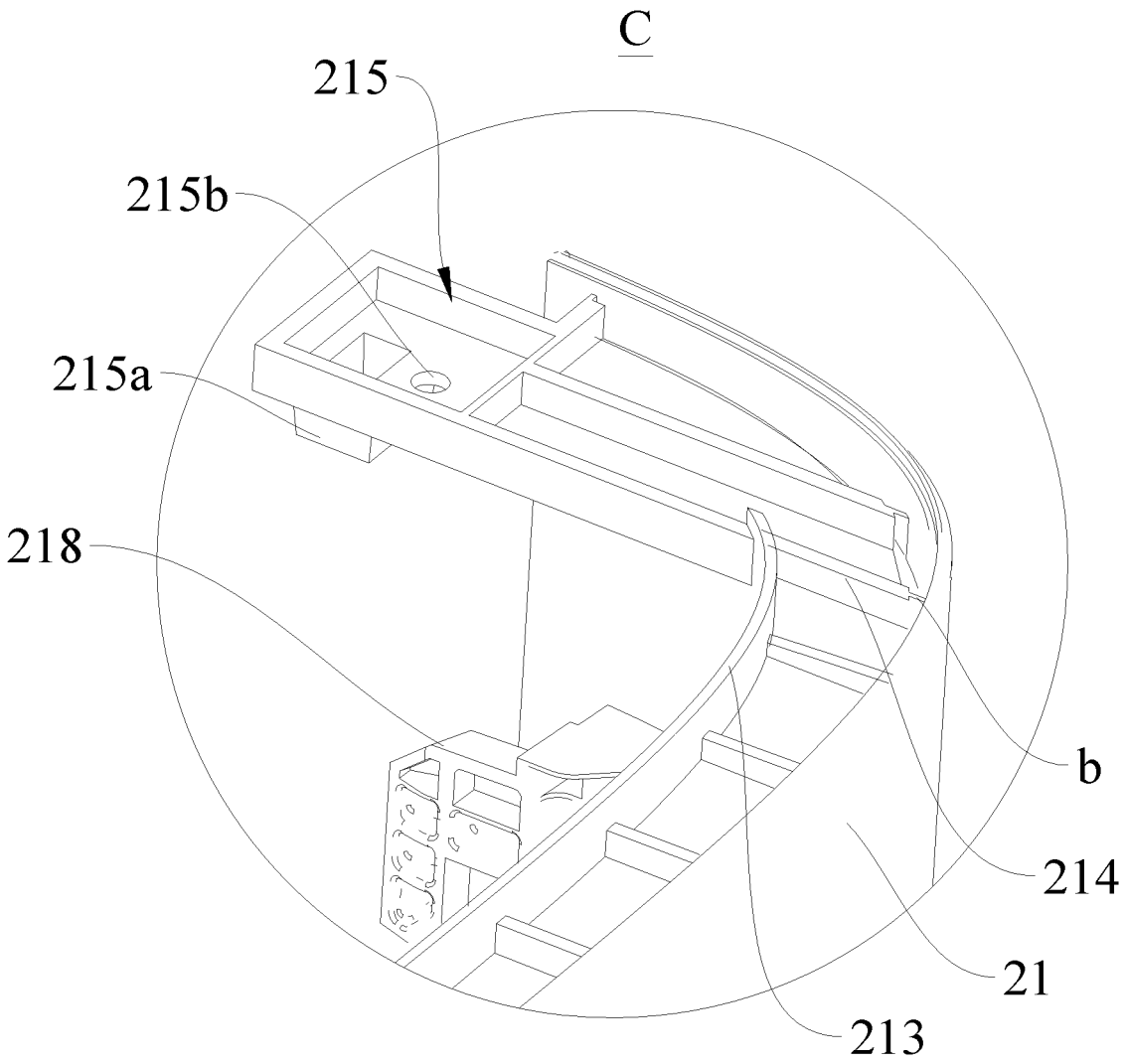
FIG. 10 is an enlarged view of Area C in FIG. 4.

According to some embodiments of the present disclosure, as shown in FIGS. 4 and 10, the top of the side of the first panel 21 facing the back plate assembly 1 is provided with an extension 215 extending toward the back plate assembly 1, and the lower end of the extension 215 is provided with a positioning post 215*a*. As shown in FIGS. 11 and 12, the top of the back plate assembly 1 is provided with a positioning hole 11, and the positioning post 215*a* is adapted to extend into the positioning hole 11. It can be seen that the first panel 21 can be connected to the back plate assembly 1 by the engagement between the positioning post 215*a* and the positioning hole 11. The connection mode is simple and easy to operate, which is advantageous for improving the reliability of the first panel 21 connected to the back plate assembly 1.

In some embodiments of the present disclosure, as shown in FIG. 10, the extension 215 is provided with a first engaging hole 215*b*, the back plate assembly 1 is provided with a second engaging hole 12, and the second engaging hole 12 is disposed opposite to the first engaging hole 215*b*. The air conditioner indoor unit 100 further includes a first connector, and the first connector passes through the first engaging hole 215*b* and the second engaging hole 12 to connect the first panel 21 and the back plate assembly 1. Consequently, before the first connector passes through the first engaging hole 215*b* and the second engaging hole 12, the positioning post 215*a* on the extension 215 can extend into the positioning hole 11 on the back plate assembly 1, and thereby substantially stabilize the position of the extension 215 relative to the back plate assembly 1. At this time, the first engaging hole 215*b* can directly face the second engaging hole 12, thus facilitating the first connector to pass through the first engaging hole 215*b* and the second engaging hole 12 and improving the assembly efficiency between the first panel 21 and the back plate assembly 1.

Figure 13:
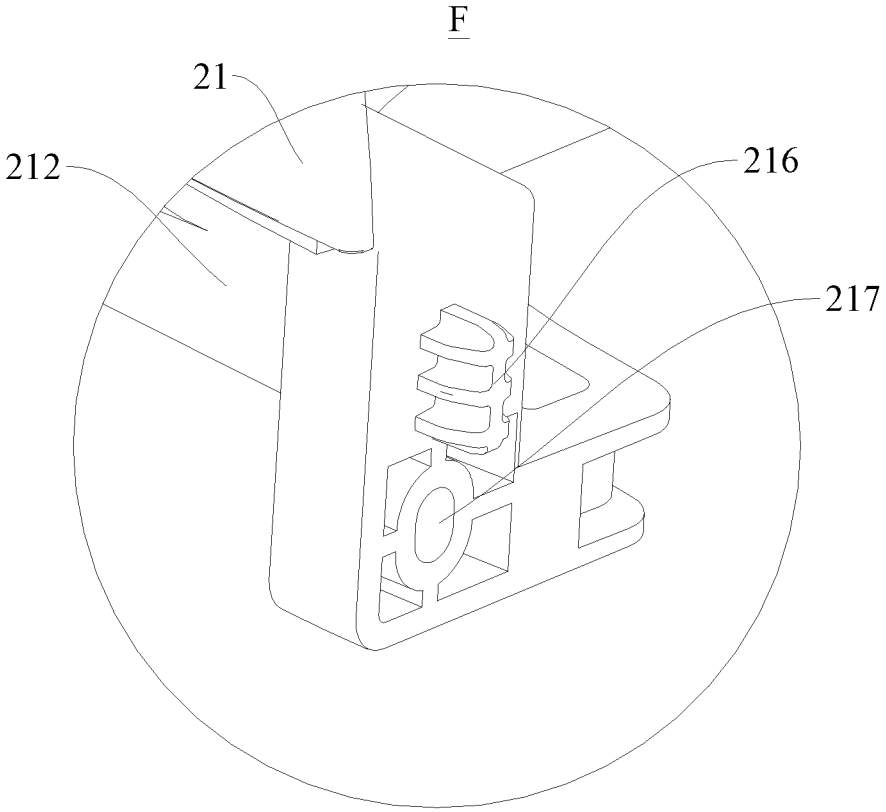
FIG. 13 is an enlarged view of Area F in FIG. 8.
Figure 14:
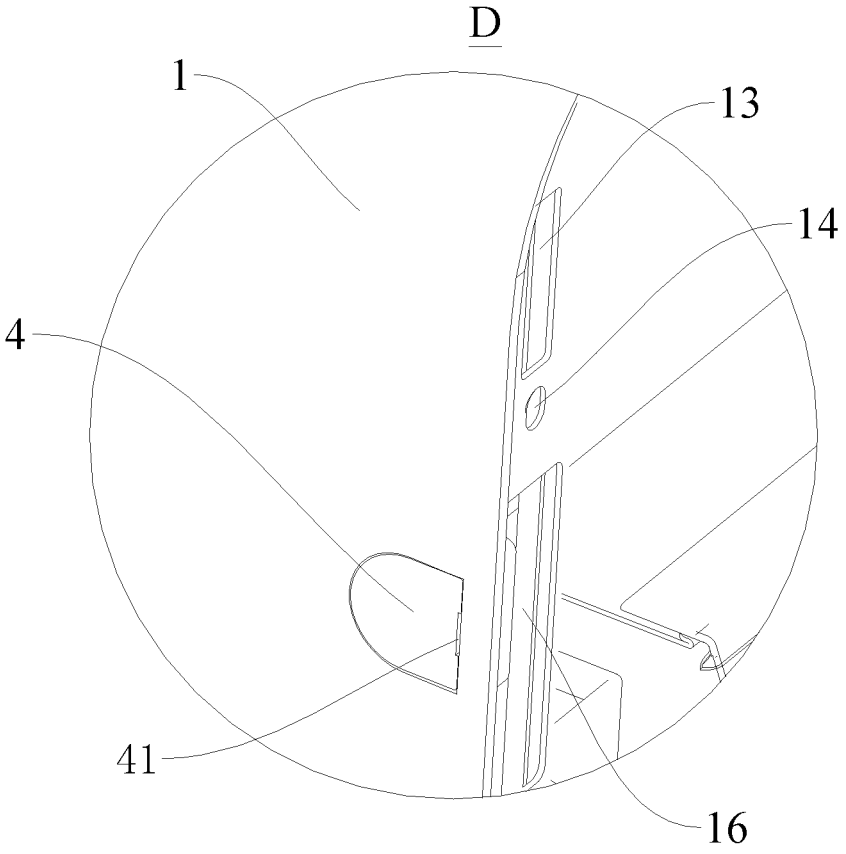
FIG. 14 is an enlarged view of Area D in FIG. 4.

According to some embodiments of the present disclosure, as shown in FIGS. 8 and 13, the bottom of the side of the first panel 21 facing the back plate assembly 1 is provided with a positioning pin 216 extending toward the back plate assembly 1. As shown in FIGS. 4 and 14, and the back plate assembly 1 is provided with a positioning receptacle 13. The positioning pin 216 is adapted to be inserted into the positioning receptacle 13. It can be seen that the bottom of the first panel 21 can be connected to the back plate assembly 1 by the engagement between the engaging hook 216 and the engaging buckle 13, and the connection method is simple and reliable, and easy for mounting and dismounting. At the same time, the positioning pin 216 also has a certain prepositioning function, which is beneficial to improve the efficiency of assembling and connecting the first panel 21 and the back plate assembly 1.

In some embodiments of the present disclosure, as shown in FIG. 13, the first panel 21 is provided with a third engaging hole 217, the third engaging hole 217 is disposed adjacent to the positioning pin 216, as shown in FIG. 14, the back plate assembly 1 is provided with a fourth engaging hole 14, the fourth engaging hole 14 is disposed opposite to the third engaging hole 217, and the air conditioner indoor unit 100 further includes a second connector, and the second connector passes through the third engaging hole 217 and the fourth engaging hole 14 so as to connect the first panel 21 and the back plate assembly 1. Consequently, before the second connector passes through the third engaging hole 217 and the fourth engaging hole 14, the positioning pin 216 on the first panel 21 can extend into the positioning hole 13 on the back plate assembly 1, and thereby substantially stabilize the position of the first panel 21 relative to the back plate assembly 1. At this time, the third engaging hole 217 can directly face the fourth engaging hole 14, thus facilitating the second connector to pass through the third engaging hole 217 and the second engaging hole 14 and improving the assembly efficiency between the first panel 21 and the back plate assembly 1. At the same time, the bottom of the first panel 21 is stably connected to the back plate assembly 1.

As shown in FIG. 2, according to some embodiments of the present disclosure, the panel assembly 2 further includes an opening and closing member 25, and the opening and closing member 25 moves back and forth to open or close the second air outlet 211*b*, and when the opening and closing member 25 moves forward to the front of the second air outlet 211*b*, the opening and closing member 25 opens the second air outlet 211*b*. It can be seen that when the opening and closing member 25 moves forward to the front side of the second air outlet 211*b*, the second air outlet 211*b* is opened to realize the ventilation function. When the opening and closing member 25 moves rearward to the second air outlet 211*b* or at the rear of the second air outlet 211*b*, the second air outlet 211*b* is closed. Thereby, the second air outlet 211*b* can be sealed to prevent particles such as dust in the room from entering the interior of the air conditioner indoor unit 100 through the second air outlet 211*b*.

As shown in FIGS. 8 and 10, according to some embodiments of the present disclosure, the top of the first panel 21 is provided with multiple first reinforce ribs 214 spaced apart from one another. Therefore, the strength of the top of the first panel 21 can be improved. When the top of the first panel 21 is connected to the back plate assembly 1, the stability of the first panel 21 on the back plate assembly 1 can be improved, thereby improving the reliability of the air conditioner indoor unit.

As shown in FIG. 1, according to some embodiments of the present disclosure, the outer surface of the first panel 21 is formed as a curved surface. Therefore, the strength of the first panel 21 can be improved, and the reliability and appearance of the air conditioner indoor unit 100 can be improved.

An air conditioner indoor unit 100 based on a specific embodiment of the present disclosure is described in detail below with reference to the drawings. It should be noted that the following description is only exemplary, and it is obvious that those skilled in the technology can combine or replace or modify some of the technical solutions or some technical features after reading the following technical solutions of the present disclosure. It falls within the scope of the present disclosure.

Figure 9:
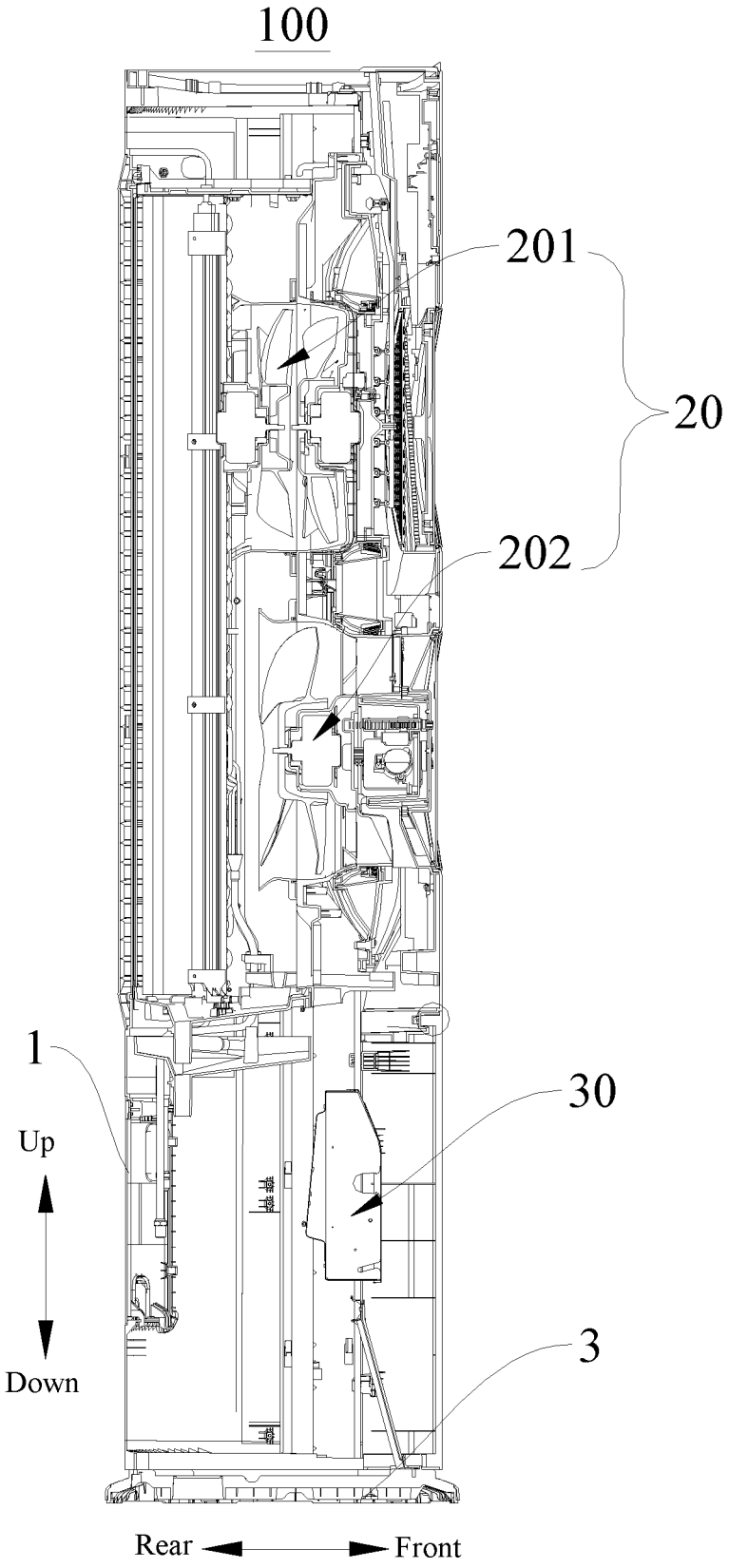
FIG. 9 is a cutaway view of an air conditioner indoor unit based on some embodiments of the present disclosure.

As shown in FIGS. 1 and 9, an air conditioner indoor unit 100 based on an embodiment of the present disclosure is in the form of cabinet. The air conditioner indoor unit 100 includes a back plate assembly 1, a panel assembly 2, a top cover assembly 5, a fan 20, an electrical controller 30, and a drive mechanism 40.

Specifically, the panel assembly 2 is located at the front of and engaged with the back plate assembly 1.

As shown in FIGS. 1 and 4, the panel assembly 2 includes a first panel 21 and a second panel 22 which are separately formed, and the first panel 21 and the second panel 22 are detachably connected. The first panel 21 and the second panel 22 are sequentially arranged in the up and down direction and are respectively connected to the back plate assembly 1.

Figure 5:
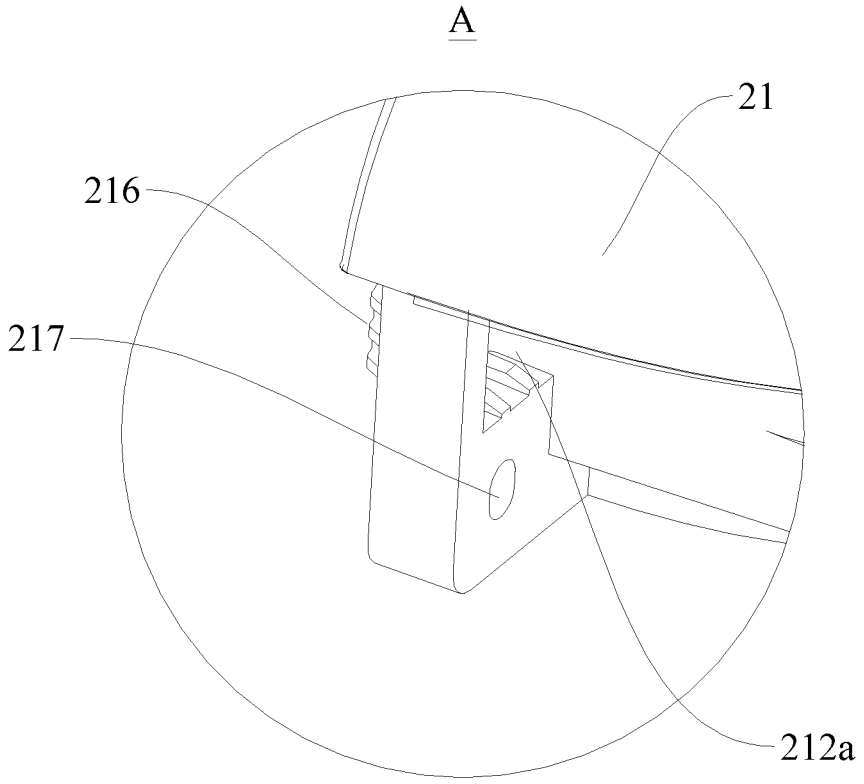
FIG. 5 is an enlarged view of Area A in FIG. 4.
Figure 7:
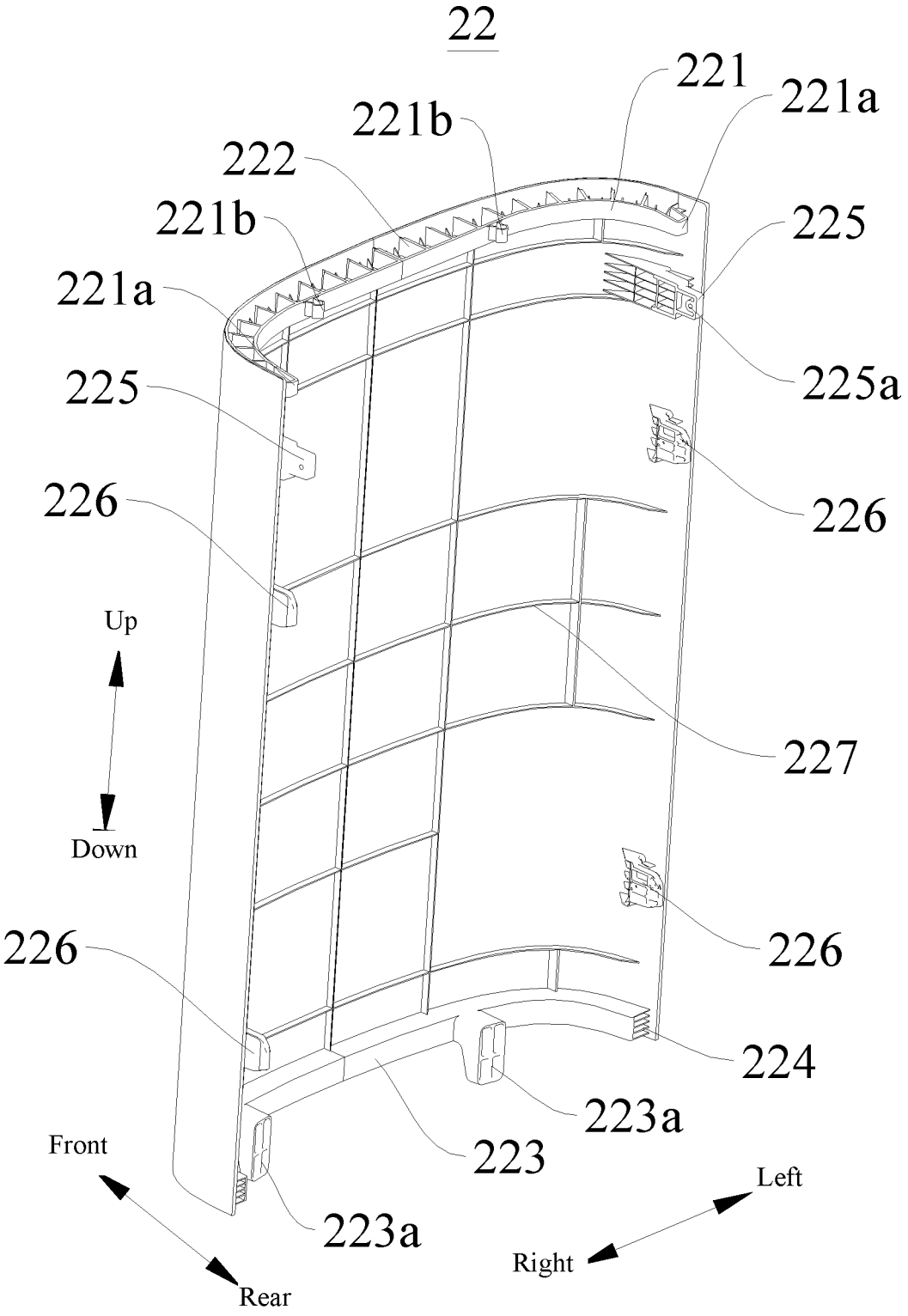
FIG. 7 is a schematic view of the second panel based on some embodiments of the present disclosure.
Figure 20:
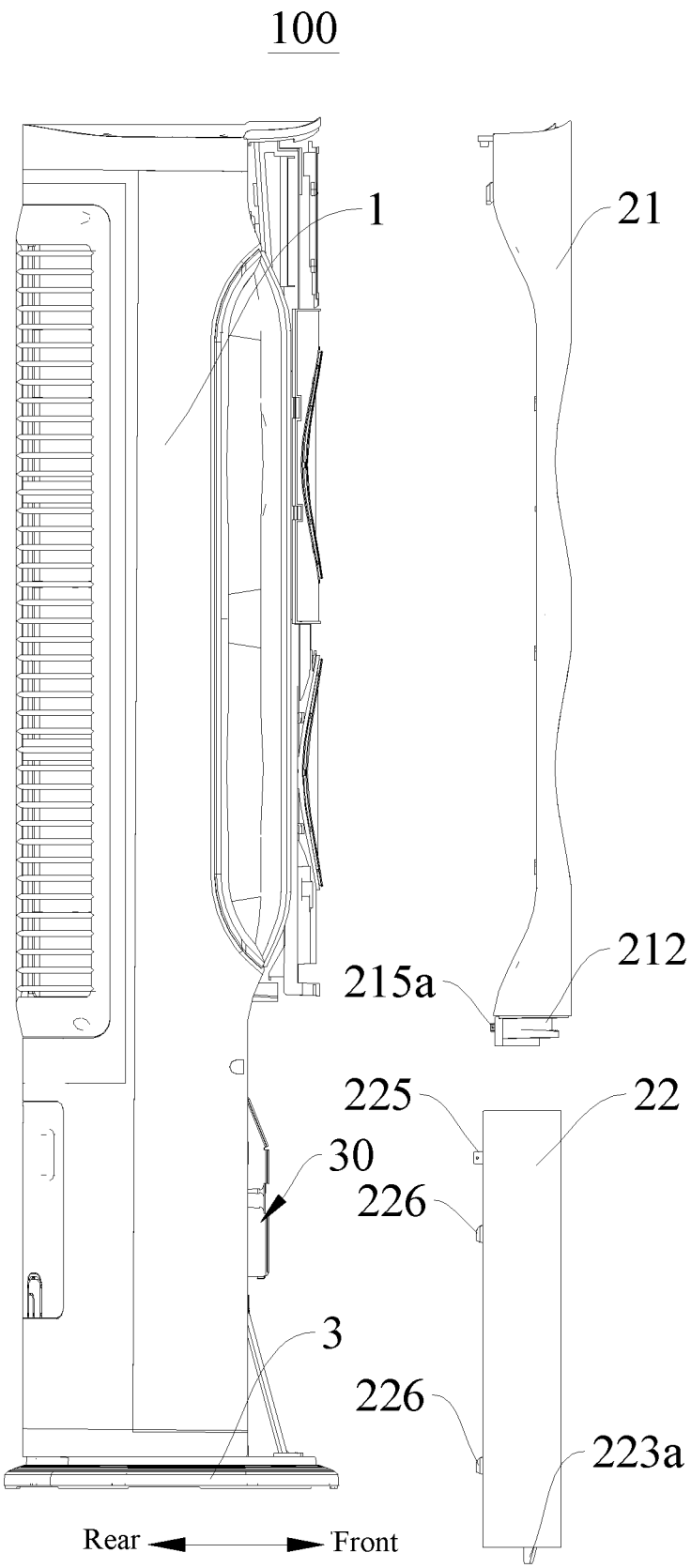
FIG. 20 is a partial structural explosion view of an air conditioner indoor unit based on some embodiments of the present disclosure.

As shown in FIG. 8 and FIG. 20, the bottom portion of the first panel 21 is folded down and back to form the connection plate 212, so that the front surface of the connection plate 212 and the front surface of the first panel 21 are formed as stepped surfaces. The connection plate 212 is provided with two engaging slots 212*b* spaced apart from each other. As shown in FIG. 5, two ends of the connection plate 212 in the left-right direction are respectively provided with a guiding jack 212*a*. As shown in FIG. 7, the rear surface of the top of the second panel 22 is provided with a fixing plate 221 extending in the same direction as the extending direction of the second panel 22. The left and right ends of the fixing plate 221 are respectively bent forward to form two guiding pins 221*a* respectively. The guiding pins 221*a* are adapted to be inserted into the corresponding guiding jacks 212*a*, thereby fixing the relative positions between the first panel 21 and the second panel 22. As shown in FIG. 7, the rear surface of the fixing plate 221 is provided with two engaging clip bulges 221*b*, and the two engaging clip bulges 221*b* are respectively arranged corresponding to the two engaging slots 212*b* on the connection plate 212, and each of the engaging clip bulges 221*b* is buckled with the corresponding engaging groove 212*b*. Therefore, it can be seen that the second panel 22 connects with the connection plate 212 on the first panel 21, and the front wall surface of the second panel 22 is level with the front wall surface of the first panel 21 after being assembled and connected. Therefore, the engaging and connecting manner of the first panel 21 and the second panel 22 is simple, easy to operate, and easy to disassemble, and at the same time, the appearance of the first panel 21 and the second panel 22 can be made more beautiful.

Figure 22:
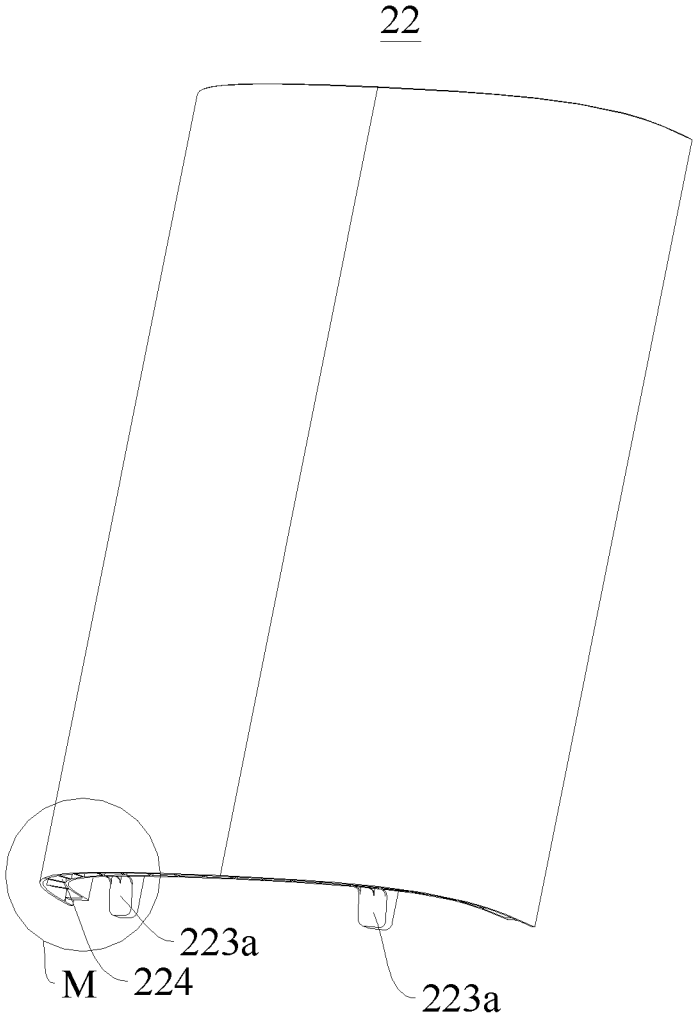
FIG. 22 is a schematic view of the second panel based on some embodiments of the present disclosure.
Figure 23:
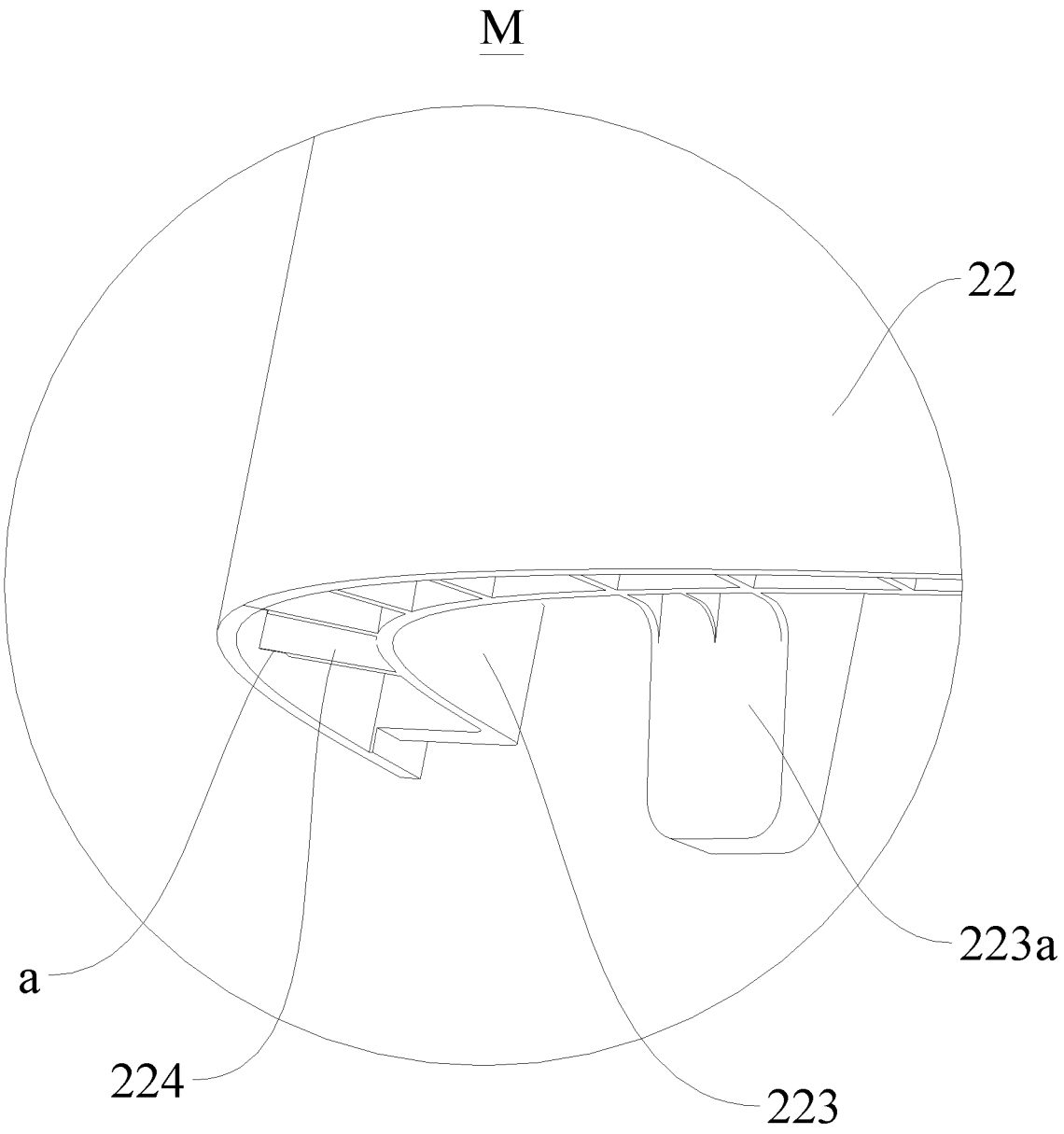
FIG. 23 is an enlarged view of Area M in FIG. 22.

As shown in FIG. 7, FIG. 22 and FIG. 23, a lower part of the rear surface of the second panel 22 is provided with a first support plate 223. The first support plate 223 extends in the same direction as the second panel 22, and the first support plate 223 is provided with an engaging pin 223*a* extending downward. As shown in FIG. 23, a cavity is disposed between the front surface of the first support plate 223 and the rear surface of the second panel 22, and multiple second reinforce ribs 224 are disposed in the cavity, and both ends of each of the second reinforce ribs 224 are respectively connected to the first support plate 223 and the second panel 22, and the joint between the second reinforce rib 224 and the second panel 22 is provided with a first thickness reducing zone a. Further, the joint between the second reinforce rib 224 and the second panel 22 can be effectively prevented from being shrunk during the injection molding process, thereby preventing the second panel 22 from being deformed, thus improving the appearance, and improving the overall strength of the second panel 22, and simultaneously improving the yield of the injection molding of the second panel 22.

As shown in FIGS. 8 and 10, the top of the rear surface of the first panel 21 is provided with a second support plate 213, and the second support plate 213 extends in the same direction as the second panel 22 extends. A cavity is disposed between the front surface of the second support plate 213 and the rear surface of the first panel 21, and multiple first reinforce ribs 214 are disposed in the cavity, and both ends of each of the first reinforce ribs 214 are respectively connected to the second support plate 213 and the first panel 21, and the joint between the first reinforce rib 214 and the first panel 21 is provided with a second thickness reducing zone b.

Figure 6:
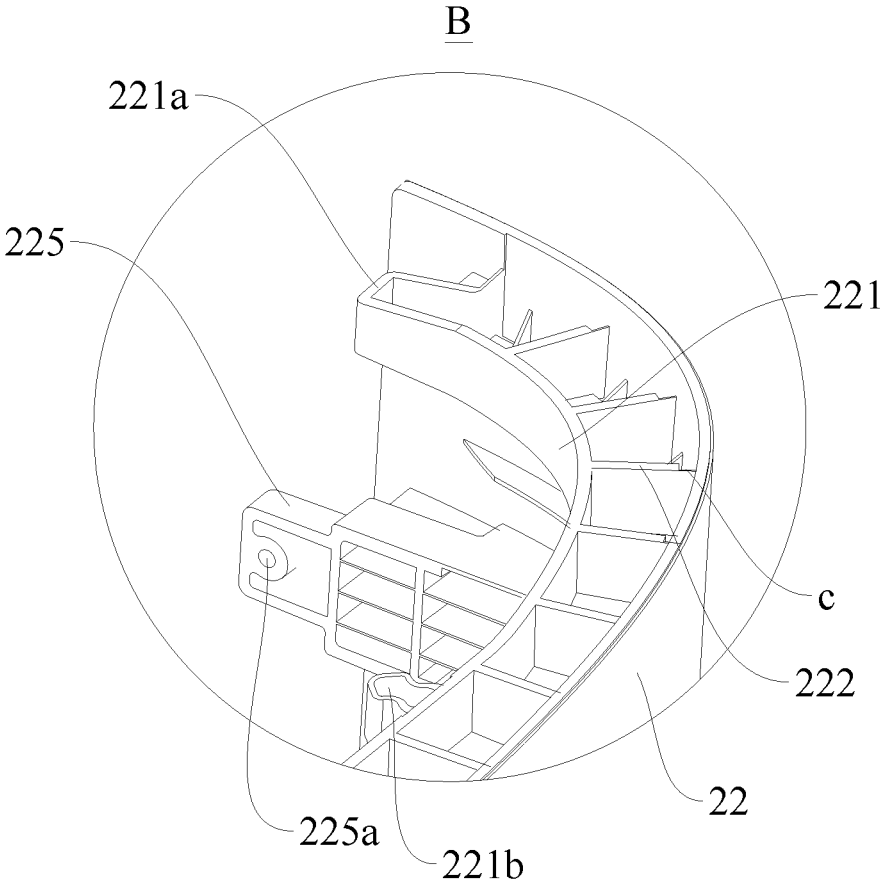
FIG. 6 is an enlarged view of Area B in FIG. 4.

Specifically, as shown in FIGS. 6 and 7, a cavity is disposed between the front surface of the support plate 221 and the rear surface of the second panel 22, and multiple third reinforce ribs 222 are disposed in the cavity, and both ends of each of the third reinforce ribs 222 are respectively connected to the support plate 221 and the second panel 22. As shown in FIG. 6, the joint between each third reinforce rib 222 and the second panel 22 is provided with a third thickness reducing zone c. Therefore, the material consumption in the injection molding process of the joint between the third reinforce rib 222 and the second panel 22 can be reduced to some extent. Further, the joint between the third reinforce rib 222 and the second panel 22 can be effectively prevented from being shrunk during the injection molding process, thereby preventing the second panel 22 from being deformed, thus improving the appearance, and improving the overall strength of the second panel 22, and simultaneously improving the yield of the injection molding of the second panel 22.

As shown in FIG. 7, the rear surface of the second panel 22 is provided with multiple fourth reinforce ribs 227 spaced apart from one another, which is beneficial to improve the structural strength and reliability of the second panel 22, thereby improving the reliability of the air conditioner indoor unit 100.

As shown in FIGS. 8 and 10, the top of the rear surface of the first panel 21 is provided with an extension 215 extending toward the back plate assembly 1, and there are two extensions 215 located at both ends of the second support plate 213. A positioning post 215*a* is provided at the lower end of each of the extensions 215. As shown in FIG. 11 and FIG. 12, the top of the back plate 1 is provided with a positioning hole 11 corresponding to each positioning post 215*a*, and the positioning post 215*a* is adapted to extend into the corresponding positioning hole 11. As shown in FIG. 10, each of the extensions 215 is provided with a first engaging hole 215*b*. As shown in FIG. 12, the back plate assembly 1 is provided with a second engaging hole 12, and the second engaging hole 12 faces directly to the first engaging hole 215*b*, and the screw passes through the first engaging hole 215*b* and the second engaging hole 12 to connect the first panel 21 and the back plate assembly 1.

As shown in FIGS. 8 and 13, the top of the rear surface of the first panel 21 is provided with a positioning pin 216 extending toward the back plate assembly 1. As shown in FIGS. 4 and 14, the back plate assembly 1 is provided with a positioning receptacle 13. The positioning pin 216 is adapted to be inserted into the positioning receptacle 13. As shown in FIG. 13, the first panel 21 is provided with a third engaging hole 217, the third engaging hole 217 is disposed adjacent to the positioning pin 216, as shown in FIG. 14, the back plate assembly 1 is provided with a fourth engaging hole 14, the fourth engaging hole 14 is disposed opposite to the third engaging hole 217, and the screw passes through the third engaging hole 217 and the fourth engaging hole 14 to connect the first panel 21 and the back plate assembly 1.

As shown in FIGS. 8 and 15, the rear surface of the first panel 21 is provided with an engaging hook 218. As shown in FIGS. 11 and 12, the back plate assembly 1 is provided with an engaging buckle 15 where the engaging hook 218 extends. Specifically, as shown in FIG. 15, the engaging hook 218 includes a horizontal extension section 218*a* and a vertical extension section 218*b*, one end of the horizontal extension section 218*a* is disposed at the first panel 21, and the other end of the horizontal extension section 218*a* is connected to the upper end of the vertical extension section 218*b*, and the lower end of the vertical extension section 218*b* is adapted to extend into the engaging buckle 15. Meanwhile, the engaging buckle 15 is formed as a hollow structure.

As shown in FIG. 11, the air conditioner indoor unit 100 further includes an air outlet frame assembly 50, and the air outlet frame assembly 50 is connected to the back plate assembly 1, and the air outlet frame assembly 50 is also provided with an engaging buckle 15. There are multiple engaging hooks 218 and one of them engages with the engaging buckles 15 on the back plate assembly 1, and the other engaging hook 218 engages with the engaging buckle 15 on the air outlet frame assembly 50.

As shown in FIG. 4, the air conditioner indoor unit 100 further includes a chassis 3, and the back plate assembly 1 is located above the chassis 3 and connected to the chassis 3. As shown in FIG. 1, the second panel 22 is disposed at the chassis 3, as shown in FIG. 4 and FIG. 7, the chassis 3 is provided with an engaging jack 31, and the engaging pin 223*a* on the second panel 22 is adapted to be inserted into the engaging jack 31. There are multiple engaging pins 223*a* spaced apart from one another, and there are multiple engaging jack 31 disposed in one-to-one correspondence with engaging pins 223*a*. Thereby, the positional relationship between the second panel 22 and the chassis 3 can be effectively fixed to facilitate the connection between the second panel 22 with the chassis 3. At the same time, it is understood that the back plate assembly 1, the panel assembly 2, the chassis 3, the protection cover 4, and the top cover assembly 5 constitute the housing 10 of the air conditioner indoor unit 100.

Figure 16:
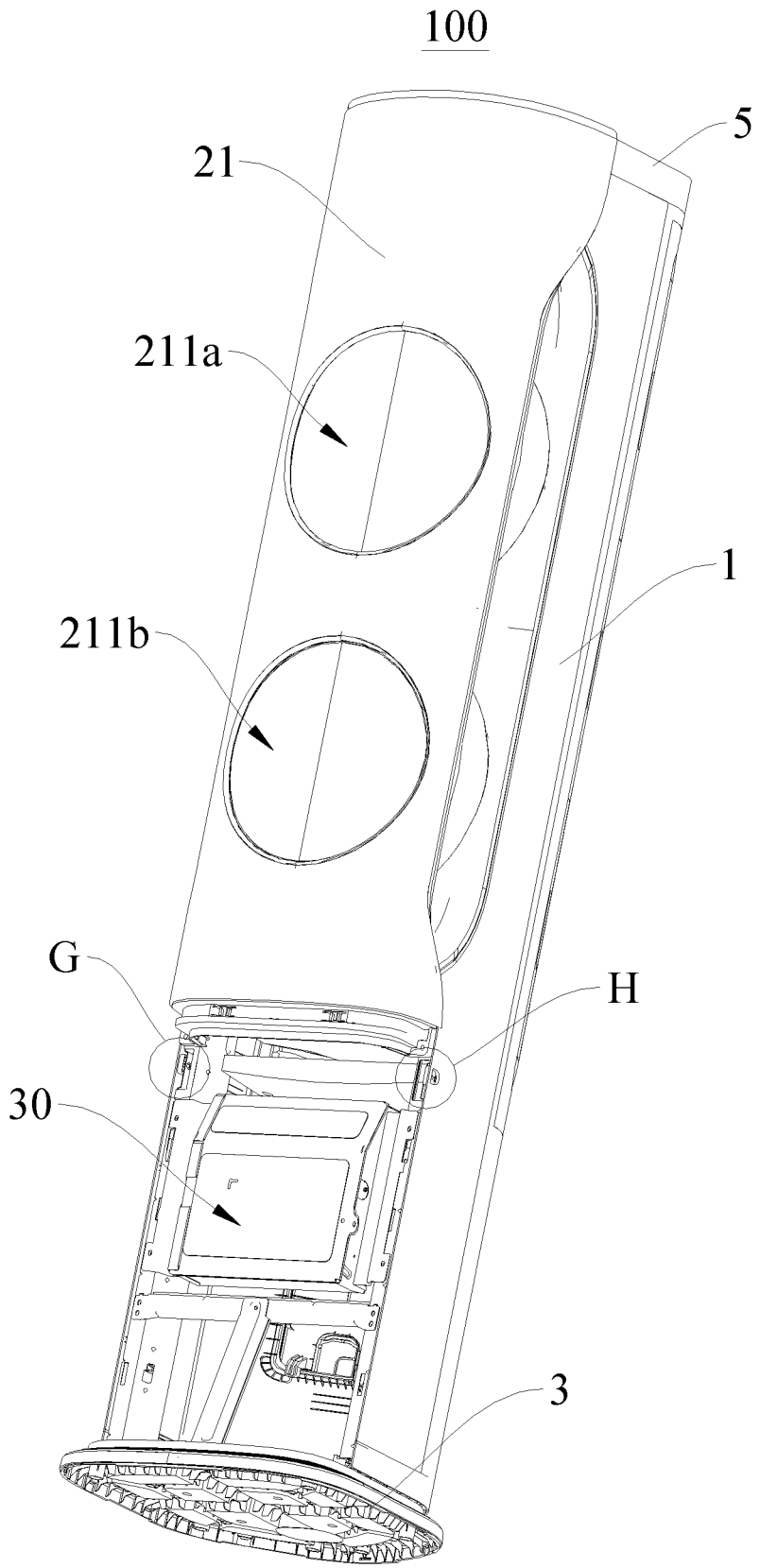
FIG. 16 is a partial schematic view of an air conditioner indoor unit based on some embodiments of the present disclosure.
Figure 17:
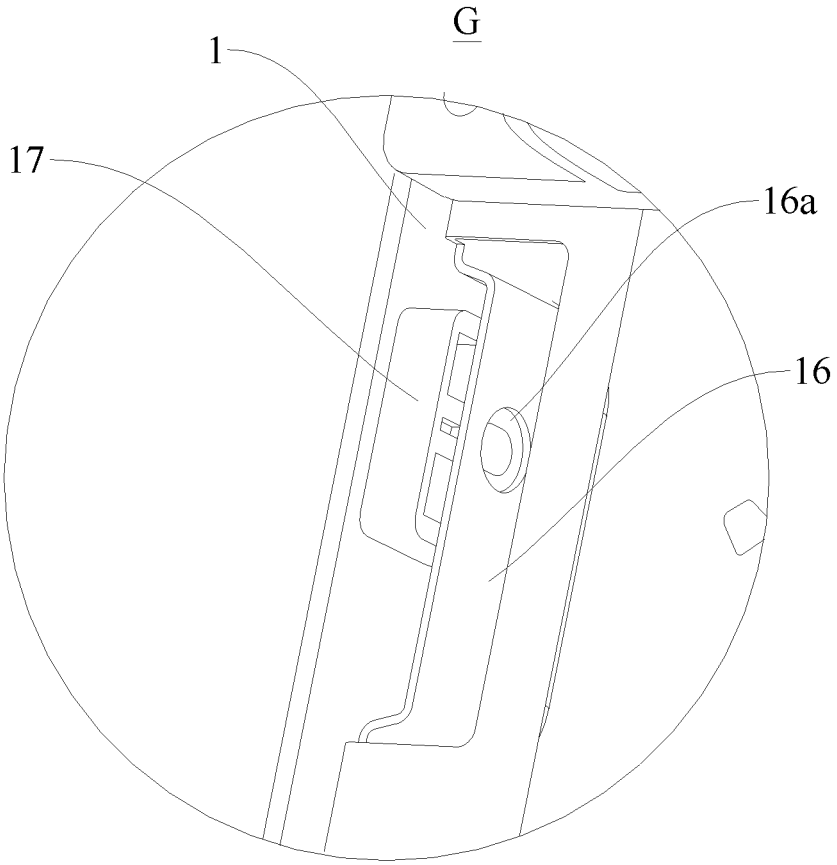
FIG. 17 is an enlarged view of Area Gin FIG. 16.
Figure 18:
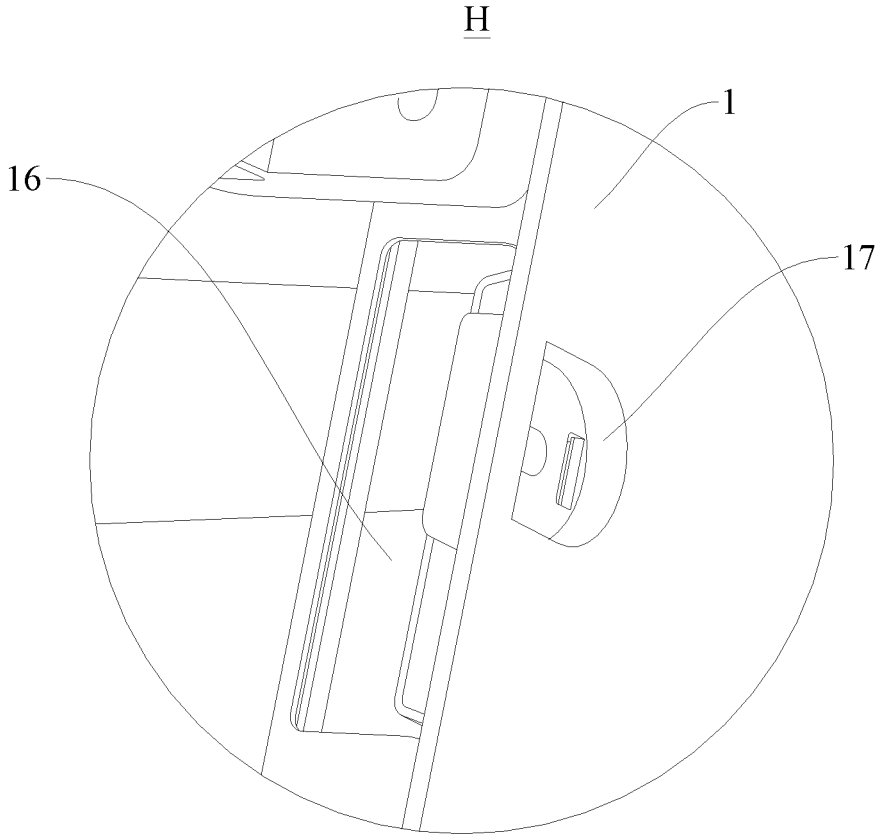
FIG. 18 is an enlarged view of Area H in FIG. 16.

As shown in FIG. 4 and FIG. 6, the rear surface of the second panel 22 is provided with two engaging posts 225 spaced apart from each other and extending toward the back plate assembly 1, and each of the engaging posts 225 is provided with a fifth engaging hole 225*a*. As shown in FIG. 16 and FIG. 17, the front surface of the back plate assembly 1 is provided with rearwards recessed engaging slots 16, each engaging post 225 extends into the corresponding engaging groove 16, and each of the fifth engaging holes 225*a* is in the corresponding engaging groove 16, the side wall of each engaging groove 16 is provided with a sixth engaging hole 16*a*, and the sixth engaging hole 16*a* is respectively located on the left side wall and the right side wall of the back plate assembly 1. As shown in FIG. 18, the outer circumferential wall of the back plate assembly 1 is provided with inwardly recessed operation groove 17, each of sixth engaging holes 16*a* is connected to a correspondingly disposed operation groove 17 and engaging groove 16. After passing through the operation groove 17, the screw connects to the corresponding fifth engaging hole 225*a* and the sixth engaging hole 16*a*, while the screw cap can be clamped on the bottom wall of the operation groove 17. Thereby, the second panel 22 can be reliably connected to the back plate assembly 1 for easy disassembly.

As shown in FIG. 14, the air conditioner indoor unit 100 further includes a protection cover 4 that is detachably provided at the operation groove 17 so as to open or close the opening of the operation groove 17. Specifically, the protection cover 4 engages with the operation groove 17. At the same time, the edge of the protection cover 4 is provided with a notch 41. Thereby facilitate the removal of the protection cover 4 from the operation groove 17. When the protection cover 4 closes the operation groove 17, the outer wall surface of the protection cover 4 is level with the outer wall surface of the back plate assembly 1. Therefore, the appearance of the air conditioner indoor unit 100 can be more beautiful.

Figure 19:
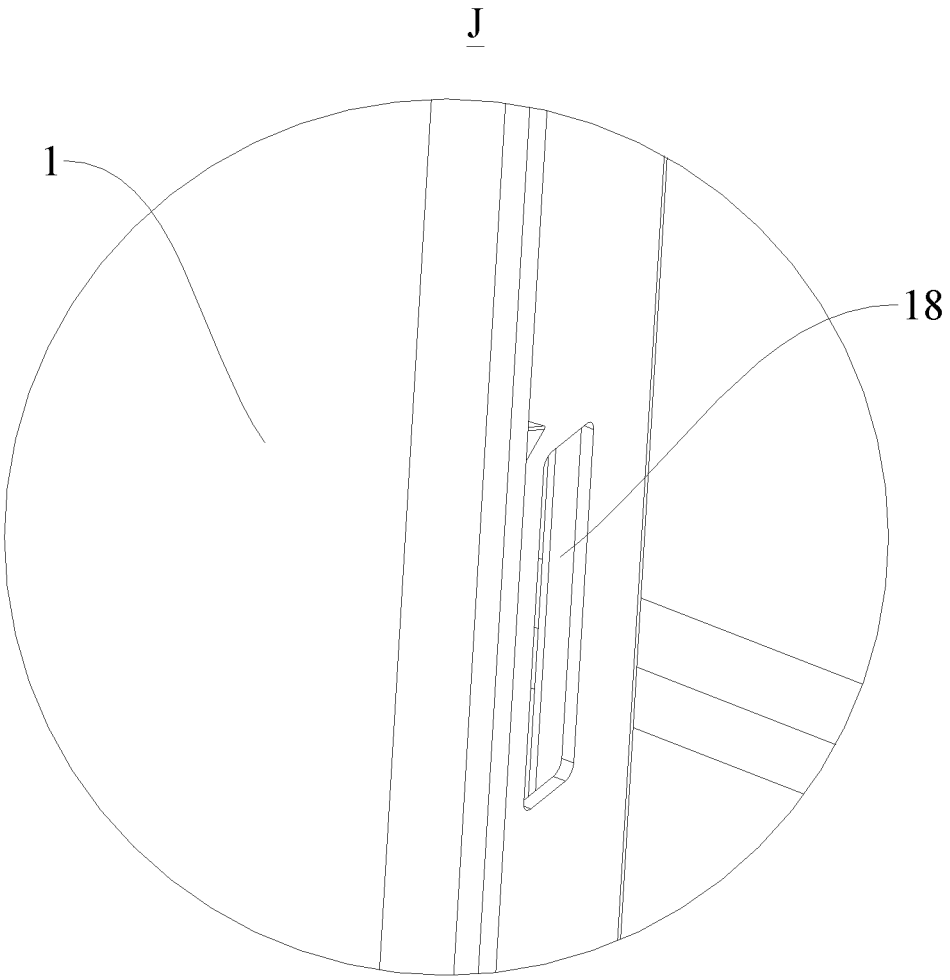
FIG. 19 is an enlarged view of Area J in FIG. 11.

As shown in FIG. 7, the rear surface of the second panel 22 is provided with multiple connection pins 226 spaced apart from each other. As shown in FIG. 11 and FIG. 19, the back plate assembly 1 is provided with multiple connection jacks 18, and the connection pins 226 are disposed in one-to-one correspondence with the connection jacks 18, and each of the connection pins 226 is adapted to extend into the corresponding connection jack 18.

As shown in FIG. 1 and FIG. 4, the top cover assembly 5 is connected to the tops of back plate assembly 1 and the panel assembly 2, respectively.

As shown in FIG. 1, the first air outlet 211*a* and the second air outlet 211*b* are disposed at the first panel 21, and the first air outlet 211*a* and the second air outlet 211*b* are sequentially arranged in the up and down direction.

As shown in FIG. 2, the panel assembly 2 also includes the door mounting plate 23, and the door mounting plate 23 is disposed at the rear of the first panel 21. The door mounting plate 23 is provided with door 24, and the door 24 is movable relative to the door mounting plate 23 so as to open or close the first air outlet 211*a*. When the door 24 moves downward relative to the door mounting plate 23, the door 24 opens the first air outlet 211*a*, and when the door 24 moves upward relative to the door mounting plate 23, the door 24 closes the first air outlet 211*a*. The drive mechanism 40 includes an actuator, a drive gear 401, and a rack 402. The actuator is disposed at the door mounting plate 23, and the drive gear 401 is connected to the actuator to be driven to rotate by the actuator, the rack 402 is connected to the door 24, and the rack 402 cooperates with the drive gear 401 to drive the door 24 to move.

As shown in FIG. 2, the panel assembly 2 further includes an opening and closing member 25, and the opening and closing member 25 moves back and forth to open or close the second air outlet 211*b*, and when the opening and closing member 25 moves forward to the front of the second air outlet 211*b*, the opening and closing member 25 opens the second air outlet 211*b*.

During assembling of the air conditioner indoor unit 100, the first panel 21 and the door mounting plate 23, the door 24 and the opening and closing member 25 can be assembled and connected together, then mounted to the back plate assembly 1. Thereafter, the second panel 22 can be engaged with the chassis 3 and the back plate assembly 1.

As shown in FIG. 9, the fan 20 is disposed in the housing 10 and located on the rear side of the first panel 21. There are two fans 20, namely the first fan 201 and the second fan 202 respectively, of which, the first fan 201 is a counter-rotating fan, and the first fan 201 is disposed opposite to the first air outlet 211*a* so as to supply air to the first air outlet 211*a*. The second fan 202 is disposed opposite to the second air outlet 211*b* so as to supply air to the second air outlet 211*b*.

The first fan 201 includes a first wind wheel and a second wind wheel disposed opposite to each other in a front-rear direction, the blades of the first wind wheel and the second wind wheel tilt in opposite directions, the first wind wheel and the second wind wheel are guide vanes for each other in the direction of air flow, thereby reducing (when the first wind wheel and the second wind wheel rotate at different speeds) or eliminating (when the first wind wheel and the second wind wheel rotate at the same speed) the rotational speed of the tangential direction of the airflow (i.e., convert from static pressure to static pressure) and improving the efficiency of the work applied by the counter-rotating fan on the air, and the airflow passing through the two wind wheels is directed toward the first air outlet 211*a*, thus realizing long-distance air supply. It should be noted that, compared with the single cross flow fan, axial flow fan or diagonal flow fan, the counter-rotating fan can realize air supply over greater distance whether the first wind wheel and the second wind wheel rotate in opposite directions at different speeds or at the same speed.

Moreover, the first wind wheel and the second wind wheel can expand the supplying range of the cool air at different rotation speeds. Because when one wind wheel rotates at a higher speed and the other wind wheel rotates at a lower speed, the wind wheel rotating at higher speed plays a leading role, and the blade airflow outlet angle based on the single-stage axial flow or diagonal flow fan is designed off the direction of the rotation axis, making the axial flow or the diagonal flow wheel itself has a wind-dissipating effect, and therefore, the angle of the cool air flowing out from the first air outlet 211*a* is large, realizing wide-angle air supply. In addition, the axial wind wheel or the diagonal flow wind wheel itself has the effect of dispersing wind, and the rotation speeds of the first wind wheel and the second wind wheel can be adjusted as needed to make them rotate at different speeds, achieving a gentle feeling or breezeless feeling, so as to avoid bad user experience caused by the cool air out of the first air outlet 211*a* blowing directly toward the user. Therefore, the air conditioner indoor unit 100 based on the embodiment of the present disclosure can realize a gentle feeling or a breezeless feeling air supply without using a wind deflector with micro holes, and the air loss is small. It should be noted that, in order to realize wide-angle air supply and breezeless air supply, it is allowed not to operate the motor corresponding to one of the wind wheels, while the other wind wheel still supplies air to one side of the first air outlet 211*a* in the forward direction. In addition, in order to realize the wide-angle air supply and the breezeless air supply, it is also allowed to make one of the wind wheels supply air in the reverse direction into the inside of the housing 10, while the other wind wheel still supply air in the forward direction. In which, the "forward air supply" means that the air flow is blown from the first air outlet 211*a* by the action of the wind wheel, and the "reverse air supply" means that the air flow is blown into the inside of the housing 10.

The electrical controller 30 is disposed in the housing 10. The electrical controller 30 is connected to the first fan 201 and the second fan 202 and is used to control the operating state of the air conditioner indoor unit 100. The electrical controller 30 is provided at the rear of the second panel 22. Therefore, while repairing the electrical controller 30, only the second panel 22 needs to be dismounted, without dismounting the first panel 21.

Other configurations and operations of the air conditioner indoor unit 100 according to embodiments of the present disclosure are known to those of ordinary skill in the art and will not be described in detail herein.

In the description of the present disclosure, it should be understood that the orientation or position relations indicated with the terms "up", "down", "front", "back", "left", "right", "vertical", "horizontal", "top", "bottom", "inner" and "outer" and the like are based on the orientation or position relationships shown in the attached drawings, are used only for the convenience of describing the present disclosure and simplifying the description, rather than indicating or implying that the device or element referred to must have a particular orientation, be constructed and operated in a particular orientation, so they shall not be construed as a restriction on the present disclosure. In addition, a feature associated with "first" or "second" may, explicitly or implicitly, include one or more such features. Unless otherwise stated, "multiple" means two or more in the description of the present disclosure.

In the description of the present disclosure, it should be noted that unless otherwise expressly specified and defined, the terms "installation", "linking" and "connection" shall be understood generally, for example, it may be fixed connection, detachable connection, or integral connection; or mechanical or electrical connections; or direct linking, indirect linking through an intermediate medium, or internal connection of two components. The specific meaning of the above terms in the present disclosure may be understood on a case by case basis by ordinary technical personnel in the field.

In the description of the present disclosure, the terms "an embodiment", "some embodiments" and "schematic embodiment", "example", "specific example", or "some examples" etc. means that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples.

Although the embodiments of the present disclosure have been presented and described, the ordinary technical personnel in the field can understand that multiple changes, modifications, substitutions and variations of such embodiments can be made without deviating from the principles and purposes of the present disclosure, and that the scope of the invention is defined by the claims and their equivalents.

The invention claimed is:

1. An air conditioner indoor unit, comprising:

a back plate assembly;

a top cover assembly, a part of the top cover assembly being detachably connected to a top wall of the back plate assembly; and a panel assembly comprising:

a first panel arranged in front of the back plate assembly and detachably connected to the back plate assembly, a top end of the first panel is connected to another part of the top cover assembly, the first panel including a first air outlet and a second air outlet arranged below the first air outlet;

a second panel disposed below the first panel, the second panel being detachably connected to a lower end of the first panel and the back plate assembly;

a door mounting plate disposed at rear of the first panel, and including a guiding groove;

a door arranged corresponding to the first air outlet and coupled to the door mounting plate, the door being movable relative to the door mounting plate to open or close the first air outlet; and a guiding post arranged at the door, the guiding post being configured to extend into the guiding groove and slide relative to the guiding groove;

wherein:

a top of a side of the first panel facing the back plate assembly includes an extension extending towards the back plate assembly;

a lower end of the extension includes a positioning post;

a top of the back plate assembly includes a positioning hole; and the positioning post is configured to extend into the positioning hole.

2. The air conditioner indoor unit according to claim 1, wherein the first panel and the second panel are two separately molded panels.

3. The air conditioner indoor unit according to claim 1, wherein:

the guiding groove includes an inclined portion extending obliquely downwards in a direction approaching the first panel; and the door is configured to close the first air outlet when the guiding post slides to the inclined portion of the guiding groove.

4. The air conditioner indoor unit according to claim 3, further comprising:

a drive mechanism configured to drive the door to move.

5. The air conditioner indoor unit according to claim 4, wherein the drive mechanism comprises:

an actuator disposed at the door mounting plate;

a drive gear connected to the actuator and configured to be driven to rotate by the actuator; and a rack engaged with the drive gear.

6. The air conditioner indoor unit according to claim 1, wherein a side of the first panel facing the back plate assembly includes an engaging hook, the back plate assembly includes an engaging buckle, and the engaging hook is configured to extend into the engaging buckle.

7. The air conditioner indoor unit according to claim 6, wherein the engaging hook comprises:

a horizontal extension section, one end of the horizontal extension section being disposed at the first panel; and a vertical extension section, an upper end of the vertical extension section being connected to another end of the horizontal extension section, and a lower end of the vertical extension section being configured to extend into the engaging buckle.

8. The air conditioner indoor unit according to claim 6, wherein the engaging buckle has a hollow structure.

9. The air conditioner indoor unit according to claim 1, wherein:

the extension includes a first engaging hole; and the back plate assembly includes a second engaging hole disposed opposite to the first engaging hole.

10. The air conditioner indoor unit according to claim 9, wherein:

the first panel includes a third engaging hole disposed adjacent to the positioning pin; and the back plate assembly includes a fourth engaging hole disposed opposite to the third engaging hole.

11. The air conditioner indoor unit according to claim 1, wherein:

the back plate assembly includes a positioning receptacle;

a bottom of a side of the first panel facing the back plate assembly includes a positioning pin extending towards the back plate assembly and configured to be inserted into the positioning receptacle.

12. The air conditioner indoor unit according to claim 1, wherein:

the panel assembly further comprises an opening and closing member configured to move back and forth to open or close the second air outlet; and when the opening and closing member moves forwards to be in front of the second air outlet, the opening and closing member opens the second air outlet.

13. The air conditioner indoor unit according to claim 1, wherein a top of the first panel includes a plurality of reinforce ribs spaced apart from one another.

14. The air conditioner indoor unit according to claim 1, wherein an outer surface of the first panel is configured as a curved surface.

* * * * *